US012150509B2

(12) United States Patent
Chilson et al.

(10) Patent No.: US 12,150,509 B2
(45) **Date of Patent: *Nov. 26, 2024**

(54) HELMET

(71) Applicant: Tianqi Technology Co (Ningbo) Ltd, Ningbo (CN)

(72) Inventors: James A. Chilson, Ketchum, ID (US); Roger Davis, Taipei (TW)

(73) Assignee: Tianqi Technology Co (Ningbo) Ltd, Ningbo (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/369,680

(22) Filed: Sep. 18, 2023

(65) Prior Publication Data

US 2024/0000180 A1 Jan. 4, 2024

Related U.S. Application Data

(63) Continuation of application No. 17/031,741, filed on Sep. 24, 2020, now Pat. No. 11,766,083, which is a continuation-in-part of application No. 16/364,047, filed on Mar. 25, 2019, now abandoned.

(51) Int. Cl.
*A42B 3/06* (2006.01)

(52) U.S. Cl.
CPC ..... *A42B 3/063* (2013.01)

(58) Field of Classification Search
CPC ..... A42B 3/063; A42B 3/064; A42B 3/065; A42B 3/127; A63B 71/08
See application file for complete search history.

(56) References Cited

U.S. PATENT DOCUMENTS 3,344,433 A * 10/1967 Stapenhill ..... A42B 3/12 2/420
3,425,061 A * 2/1969 Webb ..... A42B 3/065 D29/102

(Continued)

FOREIGN PATENT DOCUMENTS

DE 202009010204 3/2010
EP 0770338 10/1996

(Continued)

OTHER PUBLICATIONS

AZO Materials, by AzoM, "Silicone Rubber," https://www.azom.com/article.aspx?ArticleID=920, (Sep. 25, 2001).

(Continued)

*Primary Examiner* — Jillian K Pierorazio
(74) *Attorney, Agent, or Firm* — Klarquist Sparkman, LLP

(57) ABSTRACT

A helmet comprises a protective shell, an energy absorbing layer defining an inner surface of the helmet and a shear component. The shear component extends over one or more areas of the inner surface of the helmet and has an outer surface removably coupled to the inner surface of the helmet. The shear component has a distal inner surface configured to contact a wearer's head, or to support and retain a separate comfort pad configured to contact the wearer's head. In response to an oblique impact to the helmet, the shear component undergoes internal shear to allow displacement between the helmet and the wearer's head.

15 Claims, 21 Drawing Sheets

(56) References Cited

U.S. PATENT DOCUMENTS 3,720,955 A * 3/1973 Rawlings ..... A42B 3/127 2/415
3,843,970 A * 10/1974 Marietta ..... A42B 3/127 2/415
3,946,441 A * 3/1976 Johnson ..... A42B 3/063 2/412
4,012,794 A 3/1977 Nomiyama
5,204,998 A * 4/1993 Liu ..... A42B 3/124 2/425
5,351,342 A * 10/1994 Garneau ..... A42B 3/12 2/DIG. 1
5,887,288 A 3/1999 Arney et al.
6,658,671 B1 * 12/2003 Von Holst ..... A42B 3/064 2/412
8,296,863 B2 10/2012 Cripton et al.
9,462,842 B2 10/2016 Hoshizaki et al.
9,572,390 B1 2/2017 Simpson
9,839,251 B2 12/2017 Pannikottu et al.
10,010,126 B1 * 7/2018 Shaffer ..... A42B 3/064
10,098,402 B2 * 10/2018 Booher, Sr. ..... A42B 3/062
10,143,255 B2 12/2018 Golnaraghi et al.
10,143,258 B2 12/2018 Salmini et al.
10,212,979 B2 2/2019 Halldin
10,271,604 B2 4/2019 Hallander
10,306,942 B2 6/2019 Hoshizaki et al.
2001/0032351 A1 * 10/2001 Nakayama ..... A42B 3/064 2/412
2001/0039674 A1 * 11/2001 Shida ..... A42B 3/283 2/414
2002/0023291 A1 * 2/2002 Mendoza ..... A42B 3/064 2/412
2003/0070209 A1 * 4/2003 Falone ..... A43B 19/00 2/463
2004/0025229 A1 * 2/2004 Takahashi ..... A42B 3/128 2/412
2004/0117896 A1 6/2004 Madey et al.
2004/0168246 A1 9/2004 Phillips
2004/0250340 A1 12/2004 Piper et al.
2005/0246824 A1 * 11/2005 Berger ..... B29C 51/10 2/412
2005/0262619 A1 12/2005 Musal et al.
2006/0059606 A1 * 3/2006 Ferrara ..... A01N 25/18 2/412
2006/0205303 A1 * 9/2006 Nurnberg ..... A41D 31/285 442/123
2006/0253964 A1 11/2006 Dennis et al.
2006/0260026 A1 * 11/2006 Doria ..... A42B 3/127 2/414
2009/0260133 A1 * 10/2009 Del Rosario ..... A42B 3/063 2/412
2010/0115686 A1 5/2010 Halldin
2010/0205722 A1 * 8/2010 Kim ..... B32B 3/10 2/455
2011/0320011 A1 * 12/2011 Anhalt ..... C08G 61/02 623/36
2012/0036620 A1 * 2/2012 Harris ..... A42B 3/127 2/414
2012/0060251 A1 * 3/2012 Schimpf ..... A42B 3/064 2/5
2012/0151663 A1 * 6/2012 Rumbaugh ..... A42B 3/065 2/410
2012/0198604 A1 * 8/2012 Weber ..... A42B 3/064 2/410
2012/0297526 A1 * 11/2012 Leon ..... A63B 71/10 2/413
2013/0055488 A1 * 3/2013 Garneau ..... A42B 3/124 2/411
2013/0232674 A1 * 9/2013 Behrend ..... A41D 13/0543 2/455
2013/0247284 A1 * 9/2013 Hoshizaki ..... A42B 3/12 2/413
2013/0305435 A1 * 11/2013 Surabhi ..... A42B 3/067 2/414
2014/0013491 A1 1/2014 Hoshizaki et al.
2014/0013492 A1 * 1/2014 Bottlang ..... A42B 3/125 2/414
2014/0090155 A1 * 4/2014 Johnston ..... A42B 3/064 2/414
2014/0209229 A1 * 7/2014 Yang ..... A43B 19/00 156/60
2014/0223641 A1 * 8/2014 Henderson ..... A42B 3/065 2/411
2014/0237706 A1 * 8/2014 O'Conner ..... A42B 1/08 2/410
2015/0047110 A1 * 2/2015 Chilson ..... A42B 3/281 29/283.5
2015/0089722 A1 * 4/2015 Berry ..... A42B 3/064 2/412
2015/0089724 A1 * 4/2015 Berry ..... A42B 3/064 2/414
2015/0113829 A1 * 4/2015 Kodad ..... B32B 3/02 383/105
2015/0122266 A1 * 5/2015 Saunders ..... A61G 15/12 128/845
2015/0157082 A1 * 6/2015 Weber ..... A42B 3/064 2/410
2015/0157083 A1 * 6/2015 Lowe ..... A42B 3/128 2/412
2015/0181978 A1 * 7/2015 Piontkowski ..... A41B 11/008 36/44
2015/0223546 A1 * 8/2015 Cohen ..... A42B 3/127 2/412
2016/0120256 A1 5/2016 Golnaraghi et al.
2016/0316847 A1 * 11/2016 Weber ..... A42B 3/064
2017/0013907 A1 1/2017 Salmini et al.
2017/0172242 A1 6/2017 Leatt et al.
2017/0188648 A1 * 7/2017 Larrabee ..... A42B 3/125
2017/0224042 A1 * 8/2017 Abraham ..... A63B 71/10
2017/0303612 A1 10/2017 Morgan
2018/0132556 A1 * 5/2018 Laperriere ..... A42B 3/064
2018/0249778 A1 * 9/2018 Brandt ..... B32B 9/047
2018/0255862 A1 9/2018 Ho
2018/0271201 A1 * 9/2018 Pritz ..... A42B 3/127
2018/0303187 A1 10/2018 Hallander
2018/0303189 A1 10/2018 Hallander
2018/0317589 A1 * 11/2018 Mestas ..... A42B 3/064
2018/0338558 A1 11/2018 Reynolds
2019/0053563 A1 * 2/2019 Ganly ..... A42B 3/08
2019/0297984 A1 * 10/2019 Krynock ..... A42B 3/06
2019/0297985 A1 * 10/2019 Weber ..... A42B 3/064
2019/0335838 A1 11/2019 Hoshizaki
2020/0008510 A1 1/2020 Garneau et al.

FOREIGN PATENT DOCUMENTS

EP 0770338 A1 * 10/1996
EP 0771534 10/1996
EP 0771534 A1 * 10/1996
EP 2428129 3/2012
EP 3581052 12/2019
EP 3422886 2/2020
WO WO2017/151028 9/2017
WO WO2018/108940 6/2018

OTHER PUBLICATIONS

Hill, George, "Kali Tava Flow Helmet," https://road.cc/content/review/262465-kali-tava-flow-helmet, (Jun. 24, 2019).
International Search Report and Written Opinion for PCT/US2019/024632 (mailed Aug. 11, 2019).
International Search Report and Written Opinion for PCT/US2021/051680, mailed Mar. 31, 2022.
Taica Corporation, "α GEL Discover Softness," 15 pp. (Mar. 2018).

* cited by examiner

HELMET

RELATED APPLICATION

This application is a continuation of U.S. patent application Ser. No. 17/031,741, filed on Sep. 24, 2020, which is a continuation-in-part of U.S. patent application Ser. No. 16/364,047, filed on Mar. 25, 2019. The prior applications are incorporated herein by reference.

BACKGROUND

Helmets and other protective headgear are used in many applications, including sports, construction, mining, industry, law enforcement, military and others, to reduce injury to a wearer. Potential injury to a wearer can occur by way of contact with hard and/or sharp objects, which can be reduced by a helmet that prevents such objects from directly contacting the wearer's head. In addition, non-contact injury to the wearer, such as results from linear and/or rotational accelerations of the wearer's head and can cause brain injury, can be reduced by helmets that absorb or dissipate the energy produced during impacts, including oblique impacts.

Conventional approaches permit a first component of a helmet to move or deform relative to at least a second component to absorb or dissipate the energy. The relative movement can be designed to occur between first and second components that are arranged as inner and outer components relative to each other, such as inner and outer layers.

Currently available approaches to providing a helmet construction that address both contact and non-contact injury suffer from drawbacks, including overly complex design, increased weight, high cost, difficulty in manufacture, a negative effect on proper fitting of the helmet to the wearer's head, and compromised airflow though the helmet, to name a few.

SUMMARY

Described below are implementations of a new helmet that addresses some of the drawbacks of conventional helmets.

According to one implementation, a helmet comprises a protective shell forming an outer surface of the helmet, an energy absorbing layer defining an inner surface of the helmet, and a shear component extending over one or more areas of the inner surface of the helmet. The shear component has an outer surface removably coupled to the inner surface of the helmet, wherein the shear component has a distal inner surface configured to contact the wearer's head, or to support and retain a separate comfort pad configured to contact the wearer's head. In response to an oblique impact to the helmet, the shear component undergoes internal shear to allow displacement between the helmet and the wearer's head.

The shear component can be formed of a material having a shear modulus of GPa 0.0001 to GPa 0.03. The shear component can be formed of a material having a Shore 00 durometer of 0 to 60.

The shear component can comprise a silicone gel sheet material. The shear component can comprise an injection-molded thermoplastic elastomer (TPE) material. The shear component can comprise a thermoplastic urethane (TPU) material.

The shear component can comprise a viscoelastic material. The shear component can be configured such that internal shear produces a damped shear action exhibiting progressively greater force in shear without high rebound. The shear component can be non-sliding.

The shear component can be configured with an outer surface comprising fabric. The shear component can comprise an insert molded textile forming the outer surface, and wherein the shear component is removably coupled to the inner surface of the helmet by touch fastening between the textile on the outer surface and touch fasteners at multiple locations on the inner surface.

The helmet can further comprise a comfort pad removably coupled to an inner surface of the shear component, and wherein the comfort pad and the shear component can be similarly shaped (e.g., with similarly shaped peripheries) with a base shaped to fit around at least a portion of the circumference of the helmet and fingers extending from the base shaped to extend along longitudinal ribs of the helmet.

The shear component can comprise protruding ribs, and the comfort pad can comprise openings shaped to receive the ribs, and wherein engagement between the ribs of the shear component and the openings of the comfort pad reduces movement of the comfort pad relative to the shear component during shear. In some implementations, at least some of the ribs can have enlarged ends larger than the openings in the comfort pad, with the enlarged ends retaining the comfort pad in place against the shear component. The ribs can be formed as one piece with the shear component. The ribs can be dimensioned to be recessed from an inner surface of the comfort pad that is configured to contact the user's head.

In some implementations, the helmet comprises a comfort pad with attachment textile on at least one surface thereof, and wherein the comfort pad is removably coupled to the shear component by touch fastening between the attachment textile on the comfort pad and touch fasteners at multiple locations on an inner surface of the shear component.

In some implementations, the shear component and the comfort pad are each formed as a single piece having respective base and finger sections that are interconnected.

In some implementations, the helmet has at least two longitudinal ribs, and the inner surface of the helmet for each of the at least two longitudinal ribs is dimensioned to protrude inwardly relative to a surrounding area and defines a shear component coupling area in which the shear component is coupled to the inner surface. In some implementations, the shear component coupling areas protrude by at least 5 mm.

In some implementations, the helmet comprises a rear recess that is recessed relative to a forward area of the helmet such that the wearer's head does not contact the inner surface of the helmet within the rear recess when the helmet is worn, thereby allowing the wearer's head to rotate relative to the inner surface more readily in response to the oblique impact to the helmet.

According to another implementation, a helmet comprises a protective shell forming an outer surface of the helmet, a first energy absorbing layer, a second energy absorbing layer and at least one displacement device. The first energy absorbing layer has a first outer surface and a first inner surface, the first inner surface being configured to couple the helmet to a wearer's head. The second energy absorbing layer has a second outer surface and a second inner surface, the second inner surface facing the first outer surface. The at least one displacement device is positioned between the first energy absorbing layer and the second energy absorbing layer. The displacement device allowing displacement between the first and second energy absorbing layers in response to an oblique impact to the helmet.

The at least one displacement device may include a shear component. A pair of opposite surfaces of the shear component can be configured to be attached to the second inner surface of the second energy absorbing layer and the first outer surface of the first energy absorbing layer, respectively, such that the shear component undergoes internal shear to allow movement between the first and second energy absorbing layers in response to an oblique impact.

The first energy absorbing layer and the second energy absorbing layer can be separated from each other at a first location by a thickness of the shear component. The shear component at the first location can have a thickness of 1.5 to 3 mm.

The shear component can be formed of a material having a shear modulus of GPa 0.0001 to GPa 0.03. The shear component can be formed of a material having a Shore 00 durometer of 0 to 60. The shear component can comprise a silicone gel sheet material.

The shear component can be configured to provide a damped shear action exhibiting progressively greater force in shear without high rebound.

The opposite surfaces of the shear component can be bonded or adhered to the second inner surface of the second energy absorbing layer and the first outer surface of the first energy absorbing layer, respectively.

The first energy absorbing layer can be formed of a deformable material, and the second energy absorbing layer can be formed with an opening smaller than the first energy absorbing layer. The first energy absorbing layer can compressed from its relaxed state and passed through the opening to assemble the first energy absorbing layer within the second energy absorbing layer.

The second energy absorbing layer can be formed with a cavity defined to extend from the opening and shaped to accommodate the first energy absorbing layer with a clearance separating the first energy absorbing layer from the second energy absorbing layer. The first energy absorbing layer and the second energy absorbing layer can be separated by 0.25 mm to 1.5 mm at the location of the shear component.

In another implementation, the at least one displacement device comprises a first sheet having a first internal side and a first external side and a second sheet having a second internal side and a second external side, wherein the respective internal sides are positioned to face each other, and wherein the first external side is configured to be attached to the second inner surface of the second energy absorbing layer, and the second external side is configured to be attached to the first outer surface of the first energy absorbing layer. The first sheet and the second sheet can be bonded together at their respective edges. A lubricating substance can be positioned between the first and second internal sides.

At least the first internal side of the first sheet and the second internal side of the second sheet can comprise a thermoplastic urethane (TPU) material, and the lubricating substance can comprise a low friction gel.

The first external side of the first sheet and the second external side of the second sheet can be bonded or adhered to the second inner surface of the second energy absorbing layer and the first outer surface of the first energy absorbing layer, respectively.

The helmet can comprise multiple displacement devices, and the first energy absorbing layer and the second energy absorbing layer can be separated by 1 to 3 mm at least at locations of the multiple displacement devices.

The second energy absorbing layer can be formed with a first cavity defined to extend from the opening and shaped to accommodate the first energy absorbing layer with a first clearance separating the first energy absorbing layer from the second energy absorbing layer, further comprising a second cavity formed in the second absorbing layer and an external engagement section protruding from the first energy absorbing layer, wherein the external engagement section is sized to fit within the second cavity with a second clearance.

The helmet can comprise a fit system for adapting the helmet to be fitted to the wearer's head, wherein the fit system is coupled to the first energy absorbing layer.

The first and second energy absorbing layers comprise at least one of EPS, EPP, EPO, vinyl nitride, urethane foam, or a plastic material having a hollow geometry designed to produce reliable crush characteristics.

At least one of the first and second energy absorbing layers can be made of a plastic material with a hollow geometry by a 3D printing process and designed to produce reliable crush characteristics.

The first energy absorbing layer is shaped to extend over at least about 80% of an inner surface area of the helmet.

The first energy absorbing layer can comprise a notch with angled sides. The notch can be configured to allow the first absorbing layer to be compressed to a smaller size to facilitate fitting the first energy absorbing layer through the opening in the second energy absorbing layer.

According to another implementation, a helmet comprises a protective shell forming an outer surface of the helmet, a first energy absorbing layer and a second energy absorbing layer having a second outer surface and a second inner surface. The second energy absorbing layer comprises an opening and a cavity extending from the opening. The first energy absorbing layer is configurable in a compressed state to pass through the opening in the second energy absorbing layer and expand from the compressed state to a relaxed state. The first energy absorbing layer in the relaxed state is sized to fit and be movable within the cavity of the second energy absorbing layer while being retained by the opening. The first energy absorbing layer comprises a first piece nested within a second piece. The first energy absorbing layer comprises a first inner surface provided on the first piece and configured to couple the helmet to a wearer's head. The first energy absorbing layer comprises a first outer surface provided on the second piece and facing the second inner surface of the second energy absorbing layer. Multiple displacement devices are positioned at multiple locations between the first energy absorbing layer and the second energy absorbing layer, the displacement devices allowing displacement between the first and second energy absorbing layers in response to an oblique impact to the helmet.

According to another implementation, a helmet comprises a protective shell, a first energy absorbing layer, a second energy absorbing layer and multiple displacement devices. The protective shell forms an outer surface of the helmet and comprises at least one outer airflow opening. The first energy absorbing layer has a first outer surface, a first inner surface and at least one inner airflow opening. The first inner surface is configured to couple the helmet to a wearer's head. The second energy absorbing layer has a second outer surface, a second inner surface and at least one intermediate airflow opening. The second inner surface faces the first outer surface. The inner, intermediate and outer airflow openings are normally positioned in alignment with each other to provide airflow to the wearer's head. The multiple displacement devices are positioned at multiple locations between the first energy absorbing layer and the second energy absorbing layer. The displacement devices allow displacement between the first and second energy absorbing layers in response to an oblique impact to the helmet.

The foregoing and other objects, features, and advantages of the invention will become more apparent from the following detailed description, which proceeds with reference to the accompanying figures.

DETAILED DESCRIPTION

Figure 1:
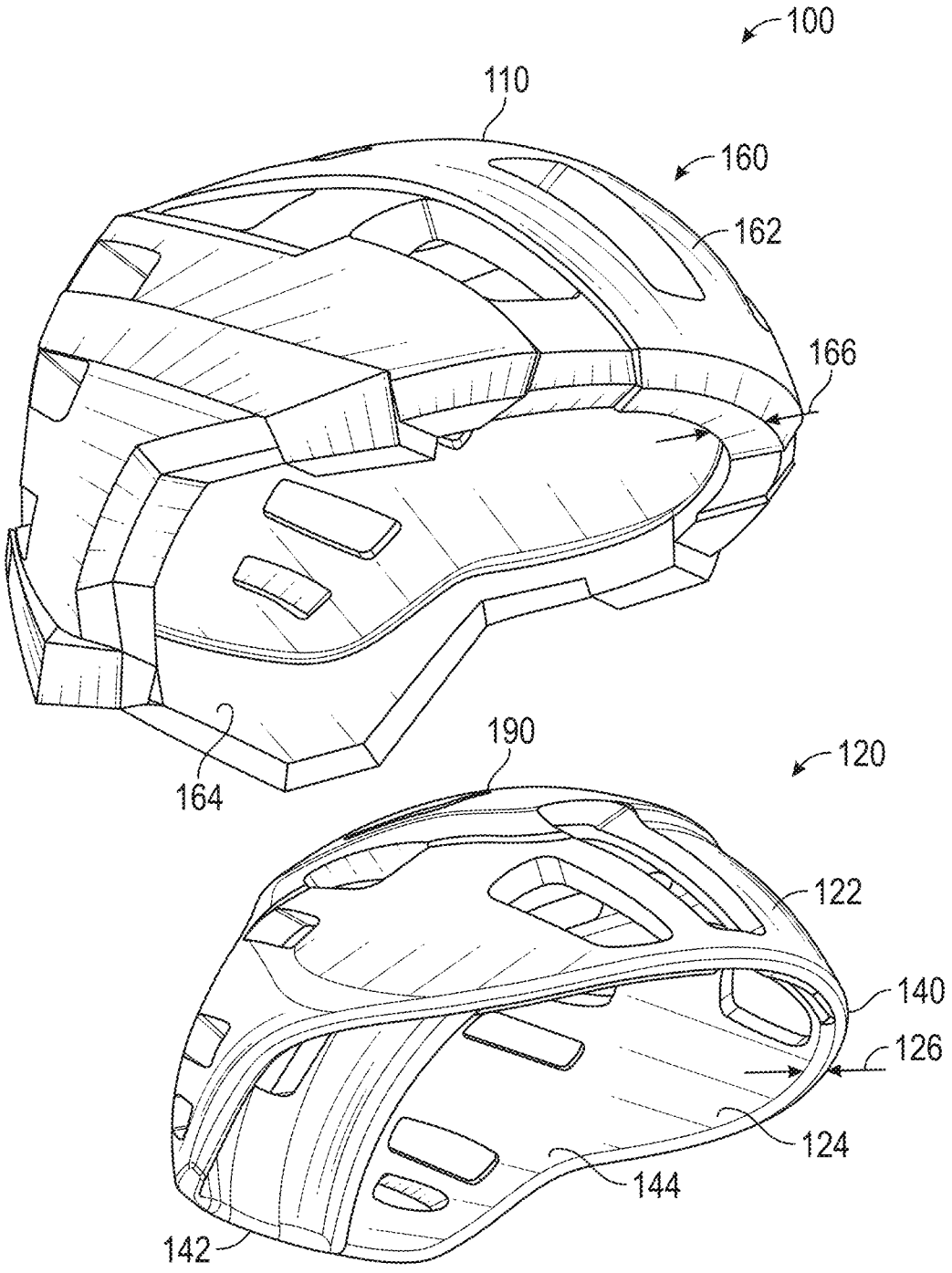
FIG. 1 is an exploded perspective view of a first implementation a helmet.

Described below are embodiments of a helmet that reduces contact and non-contact injury to a wearer's head in the event of an impact between the helmet and the ground or another object.

FIGS. 1-4 show a first implementation of a helmet 100 having first and second energy absorbing layers 120, 160, that fit together in a nested arrangement (FIGS. 2-4) and cooperate with each other. The helmet 100 has a protective shell 110 that forms an outer surface of the helmet 100, and the second energy absorbing layer 160 is attached to an inner side of the protective shell 110. The first energy absorbing layer 120 is sized to fit within a cavity defined by the second energy absorbing layer 160, as is described below in greater detail.

The first energy absorbing layer 120 defines a cavity shaped to fit over a portion of the wearer's head when the helmet 100 is worn. The first energy absorbing layer 120 has a first inner surface 124 that is positioned to face and/or contact the wearer's head, and an opposite first outer surface 122. A thickness 126 of the first energy absorbing layer 120, defined as the distance between the first inner surface 124 and the first outer surface 122 at any point on an axis extending from an approximate center of the wearer's head, can be varied at different locations over the first energy absorbing layer 120. As shown for the first energy absorbing layer, the helmet has a forward end 140 and an opposite rearward end 142.

The second energy absorbing layer 160 has a second inner surface 164 that faces the first outer surface 122 and an opposite second outer surface 162. In the illustrated implementation, the protective shell 110 can be attached to the second outer surface 162. A thickness 166 of the second energy absorbing layer 160, defined as the distance between the second inner surface 164 and the second outer surface 162 along the axis, can be varied at different locations on the second energy absorbing layer 160. As described and shown in more detail below, one or more displacement devices or elements can be positioned between the first outer surface 122 and the second inner surface 164 to facilitate displacement in the event of an impact, especially an oblique impact component thereof, i.e., to help control how the second energy absorbing layer 160 moves relative to the first energy absorbing layer 120.

For example, a representative displacement device 190 is shown positioned on the first outer surface 122 of the first energy absorbing layer 120 to face (and in some cases, contact) the second inner surface 164 when the helmet is assembled. Although for purposes of illustration in FIGS. 1-4 and 5A, only a single displacement device covering a limited area is shown, it is possible and generally typical to use multiple displacement devices (even up to 30 such devices) at dispersed locations between the first energy absorbing layer 120 and the second energy absorbing layer 160. In other implementations with fewer displacement devices, or even a single displacement device, the displacement device(s) may be much larger in area than the representative displacement device 190. The displacement devices are further described below in more detail.

Figure 5A:
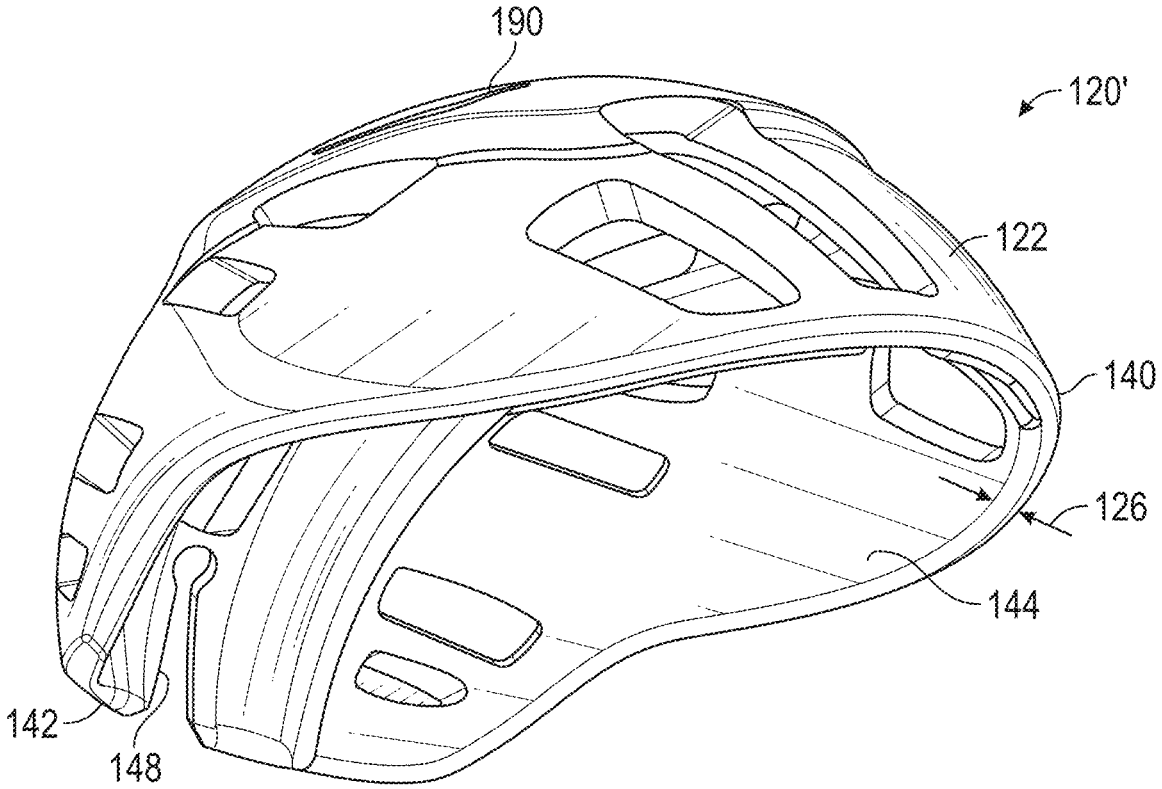
FIG. 5A is a perspective view of an alternative first energy absorbing layer for the helmet of FIGS. 1-4.
Figure 5B:
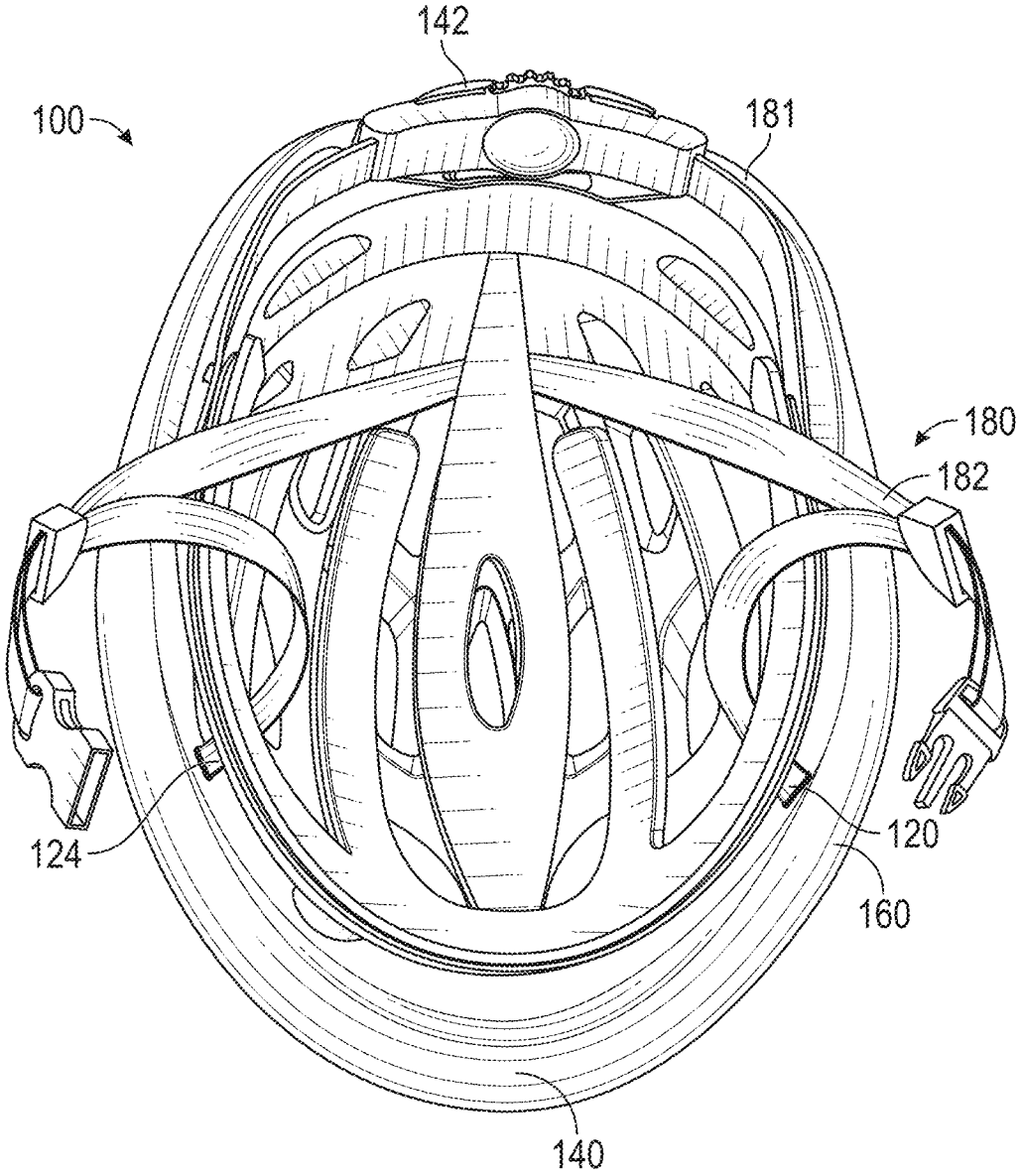
FIG. 5B is a bottom plan view of the helmet of FIG. 1, also showing a fit system for the helmet.

FIG. 5B is a bottom plan view of the assembled helmet 100 showing the cavity for accommodating the wearer's head as defined by the first inner surface 124. As also shown, the helmet 100 is typically provided with a fit system, e.g., such as a fit system 180, for adapting the size and shape of the helmet to the wearer's head. A typical fit system includes an adjustable band 181 or a portion thereof to fit the cavity of the helmet closely to the circumference of the wearer's head and one or more straps 182 to secure the helmet to the wearer's head, such as around the wearer's chin. The straps 182 are secured together by buckle parts 184.

As also described elsewhere herein, the first and second energy absorbing layers may be formed of any suitable materials. In some implementations, the first and second energy absorbing layers are formed of a foamed polymer material, such as an expanded polystyrene (EPS) material. Other shock absorbing materials, such as expanded polypropylene (EPP), vinyl nitrile foam, thermoplastic urethane (TPU) foam and others, could also be used. In some implementations, the first and/or second energy absorbing layers are formed of a plastic material having a hollow geometry designed to produce reliable crush characteristics. In some implementations, such a hollow plastic material is formed using a 3D printing or other similar process. The protective outer shell is preferably formed of a hard plastic, such as polycarbonate, ABS or other suitable plastic.

As shown in FIG. 5B, the first energy absorbing layer 120 has a substantially continuous periphery forming a generally elliptical opening sized to fit over the wearer's head. As described in more detail below, the first energy absorbing layer 120 is designed to be deformed (e.g., crushed, folded, wrapped, etc.) to fit it within the second energy absorbing layer, and then allowed to return to its relaxed, expanded state. The first energy absorbing layer 120 is then retained by one or more features on the inner side of the second energy absorbing layer 160, which can be formed features or attached features.

FIG. 5A is a perspective view of a modified first energy absorbing layer 120'. The modified first energy absorbing layer 120' has a notch or gap 148 defined along periphery, such as at the rearward end 142. The notch 148 allows the first energy absorbing layer 120' to be deformed more readily to make installation into the second energy absorbing layer 160 easier.

Figure 2:
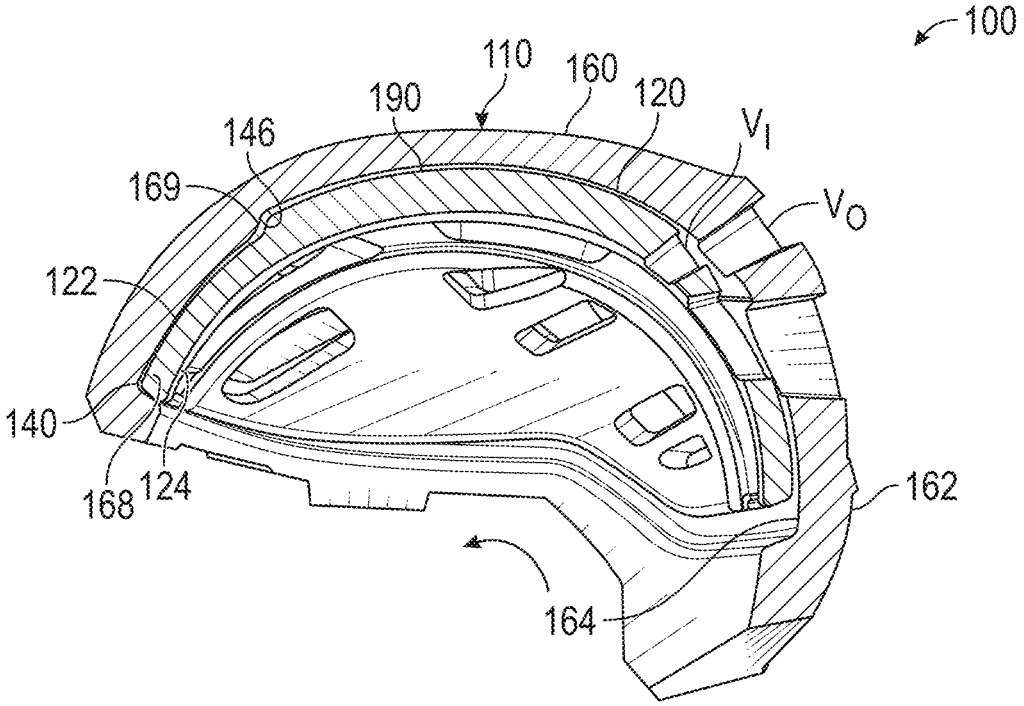
FIGS. 2-4 are sectioned side elevation views of the helmet of FIG. 1 showing first and second energy absorbing layers in three different positions relative to each other.
Figure 3:
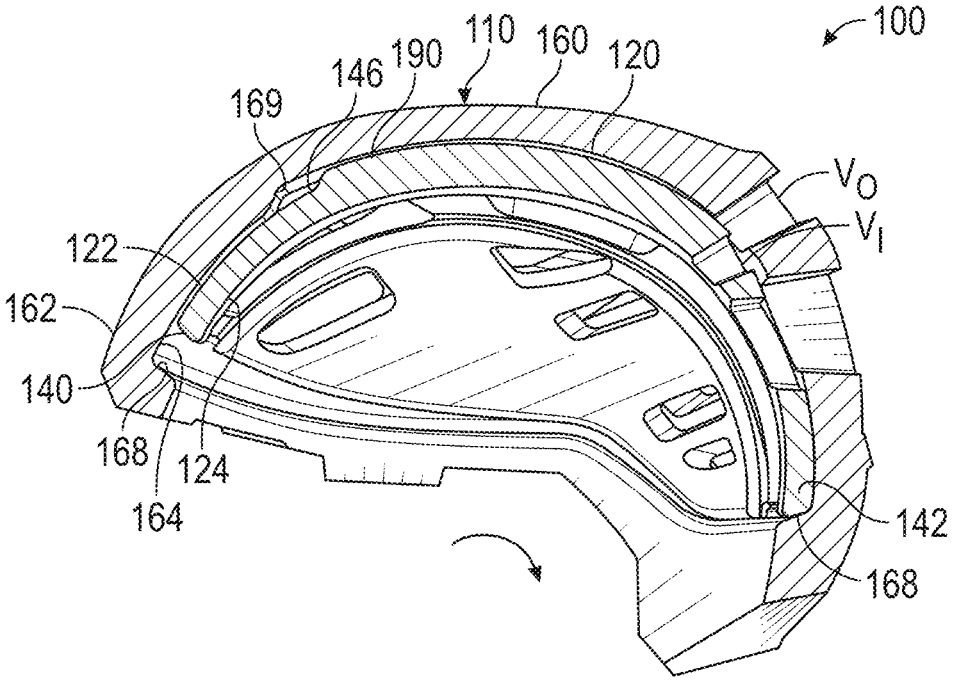
Figure 4:
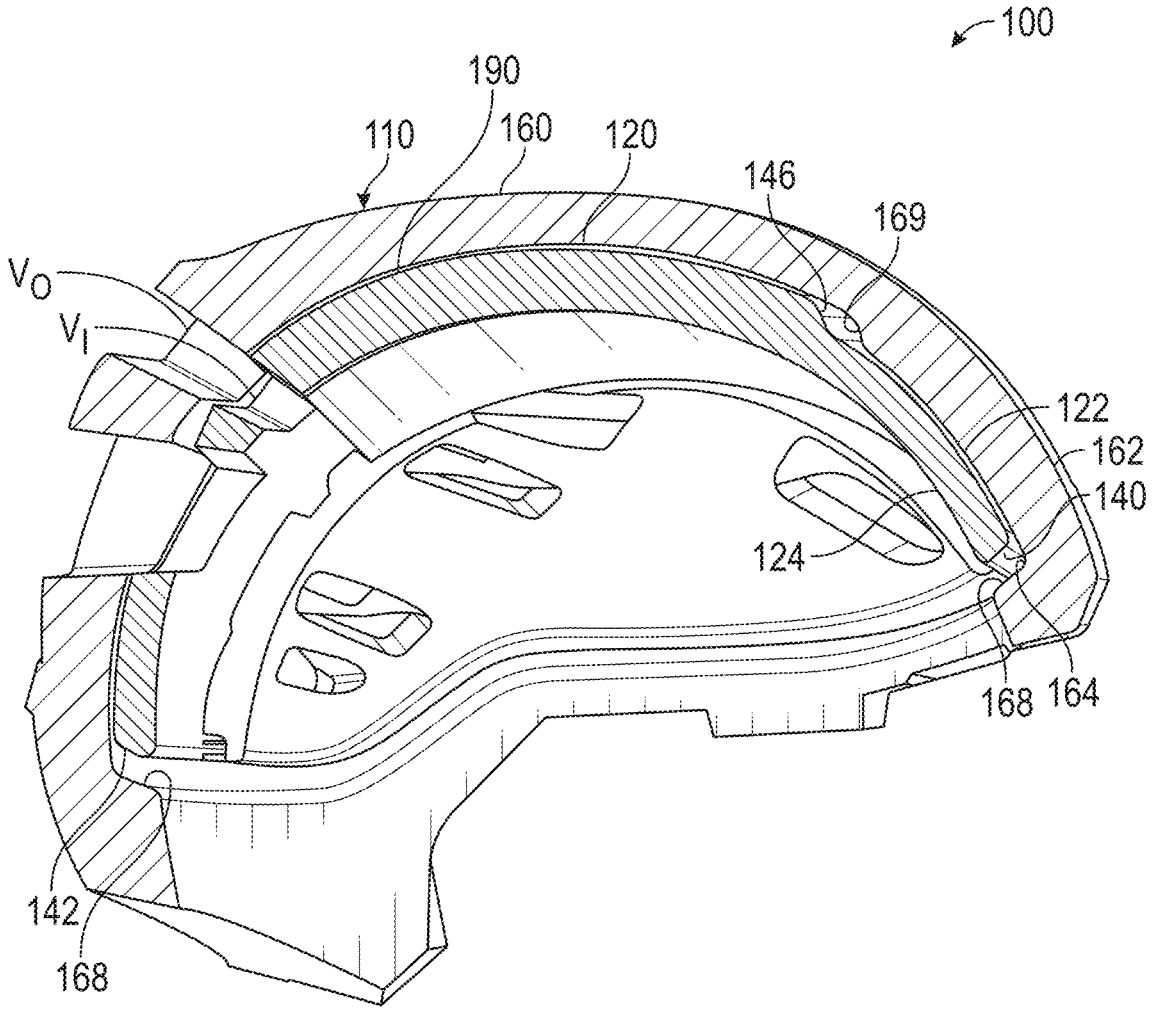

Referring again to FIGS. 2-4, sectioned side elevations of the helmet 100 depict three different positions of the first energy absorbing layer 120 relative to the second energy absorbing layer 160. In FIG. 2, the first energy absorbing layer 120 has rotated forwardly to a full extent, i.e., until the forward end 140 contacts a recessed peripheral edge 168 formed in the second energy absorbing layer 160, as facilitated by the displacement device 190. In FIG. 3, the first energy absorbing layer 120 is shown at its rearmost position in the opposite direction, i.e., the rearward end 142 is in contact with the recessed peripheral edge 168. In FIG. 4, the helmet is shown from its opposite side in a normal position, in which inner vent openings VI in the first energy absorbing layer 120 are aligned with outer vent openings VO in the second energy absorbing layer 160.

In addition, the helmet 100 can have a recess formed in the second energy absorbing layer 160, with a forward surface 169. The first energy absorbing layer 120 can have a correspondingly shaped protrusion (also referred to herein as an external engagement section), or thicker area, fitting within the recess with a facing surface 146 facing the forward surface 169. Thus, the first energy absorbing layer 120 is not limited to having a uniform thickness, but can be designed to have one or more areas having a greater thickness. Additionally, the same range of displacement between the first energy absorbing layer 120 and the second energy absorbing layer 160, as discussed in greater detail below, can still be implemented.

Figure 6:
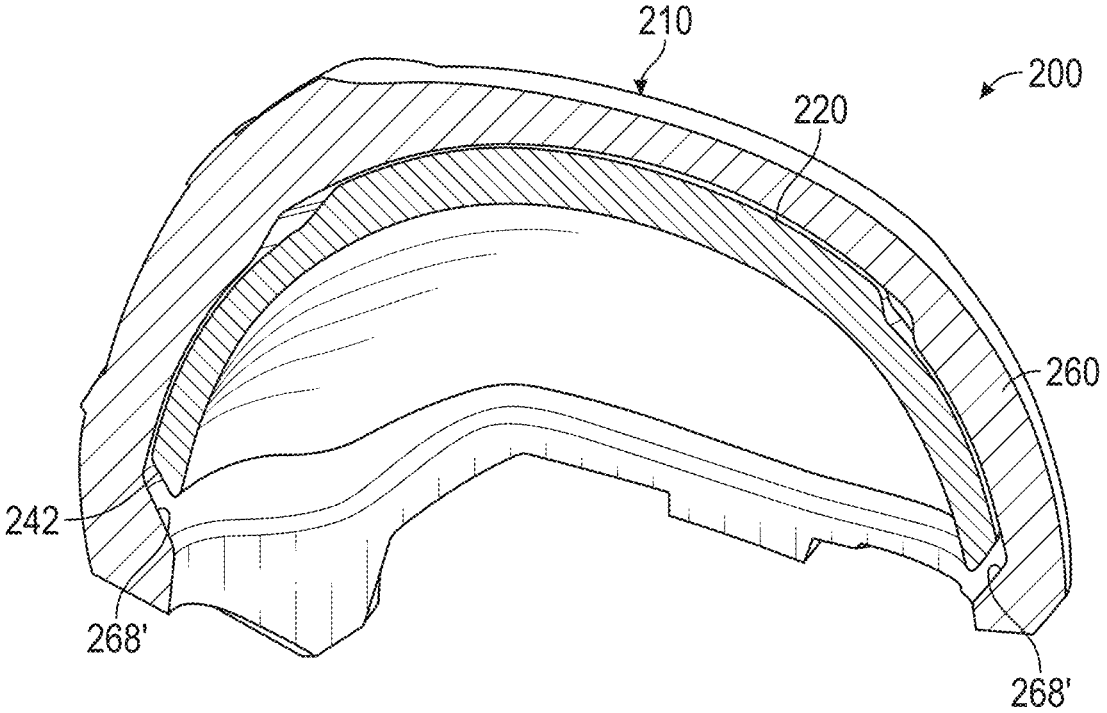
FIG. 6 is a perspective view of a section of another implementation of the helmet.

FIG. 6 is a sectioned side elevation view of a helmet 200 according to another implementation. In FIG. 6, components having generally the same description as described above are labelled with the same reference number, plus 100. In the helmet 200, a relieved edge 268' is provided on the second energy absorbing layer 260 as shown to enable easier installation of the first energy absorbing layer 220 into the second energy absorbing layer 260. Specifically, the edge 268' is relieved, such as to have a beveled shape as shown or other relieved shape or profile, to provide slightly greater space to manipulate the inner energy absorbing layer 220. In the illustrated implementation, the relieved edge 268' extends at an entry angle of approximately 45 degrees, but other entry angles of at least 30 degrees could also be used. Similarly, the adjacent surface of the first energy absorbing layer 220, such as is shown for the forward end 240 and the rearward end 242, can be inclined in the same general direction or even parallel to the relieved edge 268'. In addition, providing relieved profiles as shown, e.g., entry angles, rather than the perpendicular surfaces that meet more directly, tends to improve energy absorbing performance during impact because the contact areas are comparatively larger and the stopping of the rotational action occurs more gradually. Furthermore, in perpendicular-to-surface linear impacts, the cross section provided typically enhances energy absorption compared to 90-degree mating surfaces, since the energy-absorbing material can crack less easily, and the impact energy can be absorbed by a greater mass of material.

Figure 7:
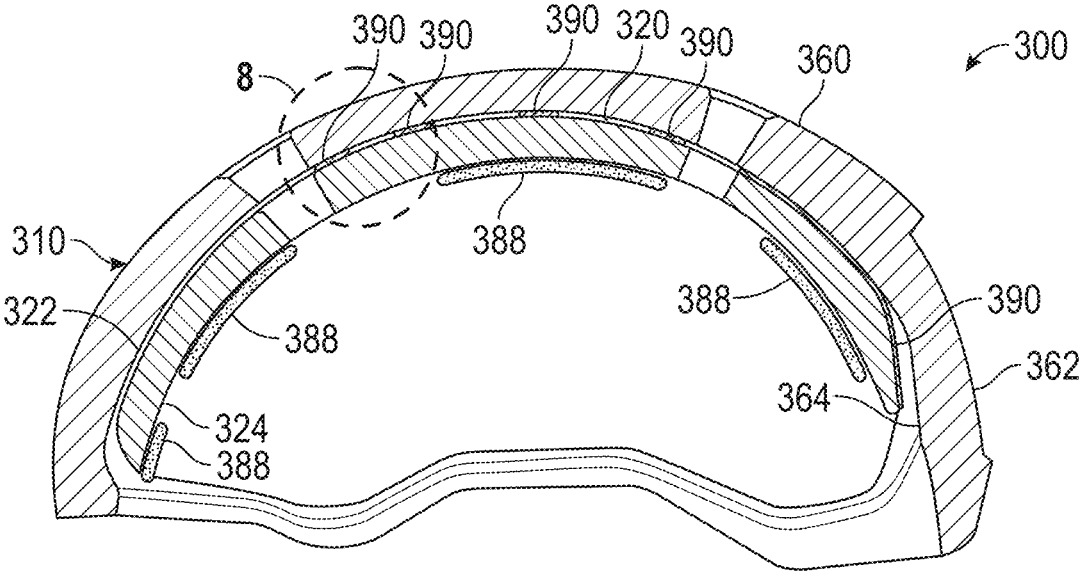
FIG. 7 is a side elevation view of another implementation of the helmet.

FIG. 7 is a sectioned side elevation of a helmet 300 according to another implementation. In FIG. 7, components having generally the same description as those for the helmet 100 set forth above are labelled with the same reference number, plus 200. As shown in FIG. 7, there are displacement devices 390 provided between the first energy absorbing layer 320 and the second energy absorbing layer 360 at multiple predetermined locations. Although described specifically for the implementation in FIGS. 7 and 8, the displacement devices 390 can be applied to any of the described implementations.

Figure 8:
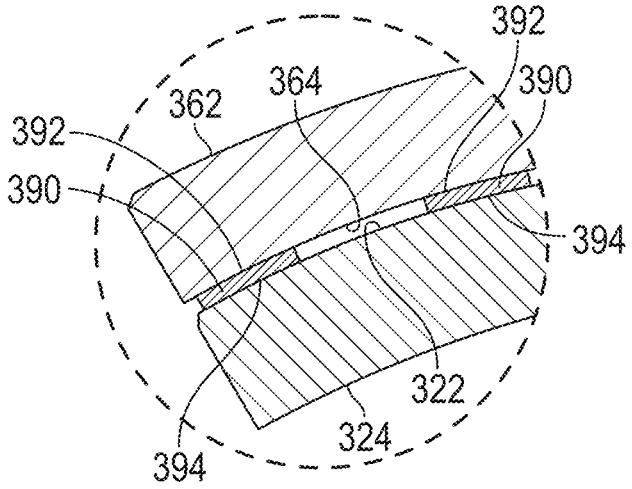
FIG. 8 is a magnified view of a portion of FIG. 7.

More specifically, and with additional reference to the magnified view shown in FIG. 8, an outer side 392 of each displacement device 390 is affixed to the first outer surface 322, and an opposite inner side 394 of each displacement device 390 is affixed to the second inner surface 364. In some embodiments, the displacement devices 390 are constructed of a silicone gel having predetermined properties selected for the application. For example, the displacement devices 390 can be pieces of silicone gel sheet material having predetermined material properties, such as a Shore 00 durometer of 0 to 60 measured using the Shore 00 scale suited for extra soft materials. Suitable silicone gels include certain silicone gels used in medical treatment of scarred tissue. As one example, a suitable class of silicone gels is available from Wacker (SilGel family 612 and 613, https://www.wacker.com/cms/en/products/brands_3/wacker-silgel/wacker-silgel.jsp). For example, Wacker SilGel 613 is described to have a dynamic viscosity (at 25° C.) of 150 MPa·s (uncured) and a density of 0.97 g/cm3 (at 23° C., cured and uncured). The material is described as having very low viscosity, rapid curing at room temperature, very low hardness, inherent tack and excellent damping properties. Technical data sheet content for Wacker SilGel 613, Version 1.1 (date of alteration 21 May 2010) is reproduced below (and also incorporated herein by reference):

| Product data | | |
|---|---|---|
| Typical general characteristics | Inspection Method | Value |
| Product Data (uncured) | | |
| Product data (uncured) | | |
| Color | | Clear |
| Viscosity, dynamic at 25° C. | DIN EN ISO 3219 | 150 mPa s |
| Density at 23° C. | | 0.97 g/cm$^3$ |
| Product data (catalyzed) | | |
| Suitable catalyst | | ELASTOSIL ® CAT PT/ELASTOSIL ® CAT PT-F |
| Mix ratio (by weight or volume) | | 10:1 |
| Viscosity of mix | ISO 3219 | 200 mPa s |
| Pot life at 25° C. ELASTOSIL ® CAT PT | ISO 2555 | >60 min |
| Pot life at 25° C. ELASTOSIL ® CAT PT-F | ISO 2555 | 5 min |
| Product data (cured) | | |
| Color | | Clear |
| Density at 23° C. | ISO 2781 | 0.97 g/cm$^3$ |
| Penetration (9.38 g hollow cone) | DIN ISO 2137 | 70 mm/10 |

Additionally, polyurethanes having similar properties to silicone gels are also suitable materials. For example, Sorbothane® material (https://www.sorbothane.com/) is another example of a suitable class of materials. See, e.g., "Data Sheet 101 Material Properties of Sorbothane® (effective Jun. 1, 2018)," specifying tensile strength, bulk modulus, density, resilience test rebound height, dynamic Young's modulus and other physical and chemical parameters of Sorbothane® materials, which is reproduced below (and incorporated herein by reference):

| | DUROMETER (Shore 00) | | | | |
|---|---|---|---|---|---|
| PROPERTY | 30 | 50 | 70 | UNITS | NOTES |
| Tensile Strength at Break | 26 | 107 | 191 | psi | ASTM D 412-06a |
| Elongation at Break | 334 | 765 | 388 | % | ASTM D 412-06a |
| Tensile Strength at 100% Strain | 6 | 13 | 58 | psi | ASTM D 412-06a |
| Tensile Strength at 200% Strain | 12 | 24 | 113 | psi | ASTM D 412-06a |
| Tensile Strength at 300% Strain | 21 | 40 | 156 | psi | ASTM D 412-06a |
| Compressive Stress at 10% Strain | 0.9 | 2.7 | 11.8 | psi | ASTM D 575-91, Method A |
| Compressive Stress at 20% Strain | 2.1 | 6.4 | 30.0 | psi | ASTM D 575-91, Method A |
| Compressive Set | 10 | 3 | 2 | % | ASTM D 395 |
| Tear Strength | 12 | 28 | 27 | lb/in | ASTM D 624-00 Die C |
| Bulk Modulus | 4.5 | 5.0 | 4.3 | gPascal | |
| Density | 83 | 84 | 86 | lb/ft$^3$ | ASTME D 792-13 |
| Specific Gravity | 1.330 | 1.36 | 1.36 | | ASTME D 792-13 |
| Optimum Performance Temperature Range | −20° to +140° | −20° to +150° | −20° to +160° | ° F. | Reduced strength and damping up to 200° F. Increased spring rate down to glass transition temperature. |
| Glass Transition | −20 | −25 | −17 | ° C. | ASTM E 1640-13 by Peak Tan Delta |
| Flash Ignition Flammability | 570° | 570° | 570° | | |
| Self Ignition Flammability | 750° | 750° | 750° | | |
| Tested Flammability Rating with Retardant | V2 | V2 | V2 | | Underwriters Laboratory UL-94 (burns but self-extinguishing when flame removed) |
| Resilience Test Rebound Height | 5 | 12 | 27 | % | ASTM D 2632-92 |
| Resilience Test Rebound Height | 4 | 11 | 25 | % | ASTM D 2632-92. Modified for the effects of material tackiness. |
| Dielectric Strength | 213 | 250 | 252 | V/ml | ASTM D 149-13, Method A |
| Dynamic Young's Modulus at 5 Hertz | 36, 41, 48 | 77, 89, 106 | 186, 209, 240 | psi | Dynamic Young's Modulus at 5 Hertz at 10%, 15%, 20% |
| Dynamic Young's Modulus at 15 Hertz | 57, 64, 75 | 113, 129, 154 | 186, 258, 295 | psi | Dynamic Young's Modulus at 15 Hertz at 10%, 15%, 20% |
| Dynamic Young's Modulus at 30 Hertz | 76, 86, 100 | 145, 165, 195 | 266, 299, 342 | psi | Dynamic Young's Modulus at 30 Hertz at 10%, 15%, 20% |
| Dynamic Young's Modulus at 50 Hertz | 95, 105, 119 | 175, 199, 231 | 298, 334, 382 | psi | Dynamic Young's Modulus at 50 Hertz at 10%, 15%, 20% |
| Tangent Delta at 5 Hz Excitation | 0.72 | 0.57 | 0.28 | | |
| Tangent Delta at 15 Hz Excitation | 0.78 | 0.62 | 0.33 | | |
| Tangent Delta at 30 Hz Excitation | 0.80 | 0.64 | 0.36 | | |
| Tangent Delta at 50 Hz Excitation | 0.80 | 0.65 | 0.37 | | |

-continued

| PROPERTY | DUROMETER (Shore 00) 30 | 50 | 70 | UNITS | NOTES |
|---|---|---|---|---|---|
| Bacterial Resistance | No Growth | No Growth | No Growth | | ASTM G 22 |
| Fungal Resistance | No Growth | No Growth | No Growth | | ASTM G 21-09 |
| Heat Aging | Stable | Stable | Stable | | 72 hours @ 158° F. shows no change in size, appearance or durometer |
| Ultraviolet Acoustic Properties Transmission Loss in Air | greater than 40 | greater than 40 | greater than 40 | decibel/cm | |
| Chemical Resistance to Distilled Water | 51.6 | 42.1 | 23.8 | % wt change | ASTM D 543, 7-day immersion |
| Chemical Resistance to City Water | 50.7 | 41.8 | 23.7 | % wt change | ASTM D 543, 7-day immersion |
| Chemical Resistance to Hydraulic Fluid | −4.8 | −3.9 | −4.2 | % wt change | ASTM D 543, 7-day immersion |
| Chemical Resistance to Kerosene | −8.4 | −4.9 | −6.1 | % wt change | ASTM D 543, 7-day immersion |
| Chemical Resistance to Diesel | −4.7 | −1.4 | 23.7 | % wt change | ASTM D 543, 7-day immersion |
| Chemical Resistance to 50% Ethanol | 98.5 | 58.4 | 51.9 | % wt change | ASTM D 543, 7-day immersion |
| Chemical Resistance to Soap Solution | 100.4 | 59.4 | 33.0 | % wt change | ASTM D 543, 7-day immersion |
| Chemical Resistance to Gasoline | 37.9 | 40.6 | 41.7 | % wt change | ASTM D 543, 7-day immersion |
| Chemical Resistance to Turpentine | 14.5 | 16.3 | 13.4 | % wt change | ASTM D 543, 7-day immersion |
| Chemical Resistance to Motor Oil 15W40 | −4.4 | −3.9 | −4.1 | % wt change | ASTM D 543, 7-day immersion |
| Chemical Resistance to Hexane | −5.1 | −7.4 | −2.8 | % wt change | ASTM D 543, 7-day immersion |
| Chemical Resistance to IRM 903 | −4.3 | 2.9 | −3.7 | % wt change | ASTM D 543, 7-day immersion |
| Chemical Resistance to IN Acetic Acid | Complete Degradation | Complete Degradation | Complete Degradation | % wt change | ASTM D 543, 7-day immersion |
| Chemical Resistance to Ethylene Glycol | −1.1 | 0.2 | 0.4 | % wt change | ASTM D 543, 7-day immersion |
| Chemical Resistance to IN NaOH | 11.9 | 10.7 | 7.2 | % wt change | ASTM D 543, 7-day immersion |

The displacement devices 390 can be dimensioned to have suitable thicknesses to maintain desired spacings between the first energy absorbing layer 320 and the second energy absorbing layer 360. In some implementations, there is a 1.5 to 3 mm space between the first energy absorbing layer 320 and the second energy absorbing layer 360 at any location, so the displacement devices 390 can be dimensioned to have a corresponding 1.5 to 3 mm thickness as appropriate. In some implementations, the first energy absorbing layer 320 is thus "suspended" within the second energy absorbing layer 360, depending upon the number and positions of the displacement devices 390. Further, the fit and spacing between the first energy absorbing layer 320 and the second energy absorbing layer 360 may provide for at least 5 mm of relative rotational travel.

The displacement devices 390 may be affixed self-adhesively, and/or with an added adhesive, including, e.g., a suitable structural adhesive, pressure-sensitive adhesive or other affixing method, such as a tape (see, e.g., the products described at www.gergonne.com/en/standard-products/gergosil.html). The displacement devices 390 may be spaced apart in a pre-determined pattern over the extent of the helmet. For example, the displacement devices 390 may be positioned to cover at least 10% of the surface areas of the inner cavity.

In the implementation of FIGS. 7 and 8, the inner surface 324 of the first energy absorbing layer 320 includes multiple comfort pads 388 that are dimensioned and positioned to fit the inner cavity of the helmet 300 to the wearer's head. The comfort pads 388 may be permanently or removably attached to the inner surface 324. In some implementations, such as is further elaborated on below, the comfort pads 388 may incorporate displacement device technology in conjunction with the displacement devices 390 to assist in managing oblique impacts.

Figure 9:
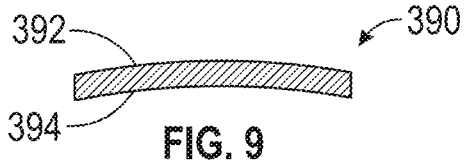
FIGS. 9 and 10 are schematic diagrams showing a displacement device of FIGS. 7 and 8 at rest and in response to an applied force.
Figure 10:
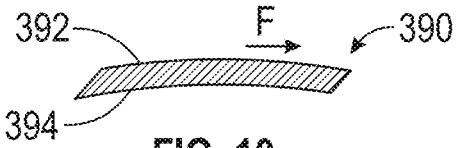

FIG. 9 is a schematic diagram of one of the displacement devices 390 shown in isolation at rest (i.e., with no applied force or torque). FIG. 10 is a schematic diagram of the displacement device 390 when subjected to a force or a torque (e.g., a force as indicated by the arrow F or a torsional loading) producing shear stress. Shear stress acts parallel or tangential to the surface of a material. In FIG. 10, the shearing force F is applied to the top surface of the shape while the bottom surface is considered to be held in place, and causing the deformation from the approximate rectangular shape in FIG. 9 to the approximate parallelogram shape in FIG. 10. Thus, the displacement devices 390 are designed to respond to applied forces and torques producing shear stress (within a predetermined range) by undergoing shear strain. The resulting deformation may be elastic deformation, in which case the displacement device returns to the shape of FIG. 9, or it may include permanent deformation or structural failure (e.g., if the forces of an oblique impact are sufficient to overcome the bonding forces between the displacement device and the adjacent surfaces).

The silicone gel and polyurethane materials as described herein are primarily implemented for use in their elastic region, i.e., such that the materials will deform during loading and then return to their original shape when the load is removed. The stress-strain curve for elastic materials, which is a progressively steepening curve, indicates that elastic materials are initially compliant and then become stiffer as the load is increased.

Figure 15A:
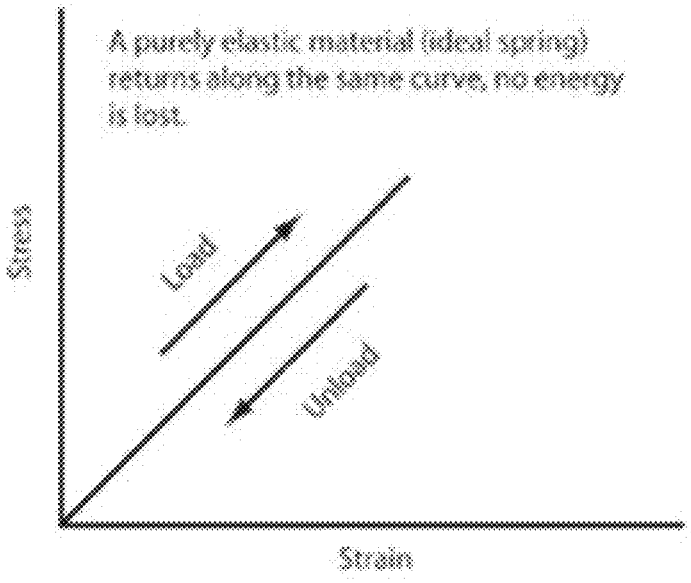
FIGS. 15A and 15B are explanatory graphs showing the relationship between applied force (stress) and displacement (strain) in purely elastic and viscoelastic materials, respectively.
Figure 15B:
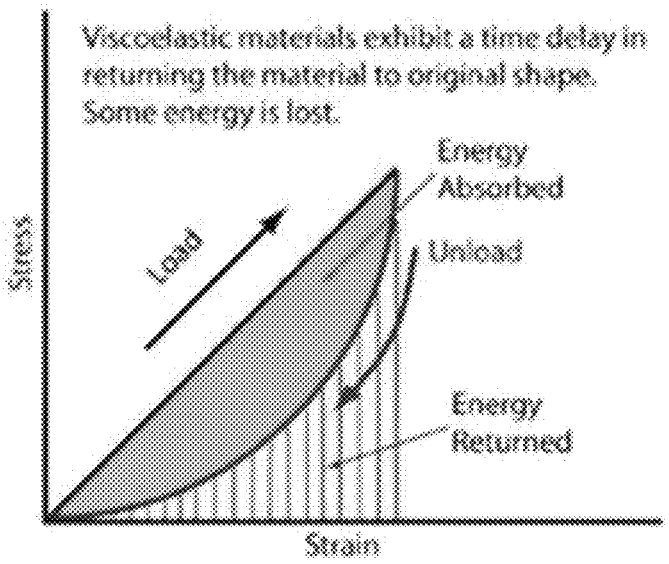

In some implementations, the silicone gel and polyurethane materials may exhibit viscoelastic effects. When an elastic material containing fluid is deformed, the return of the material to its original shape is delayed in time and it is slower to return to its original position. A purely elastic material behaves like an ideal spring with a linear response, and no energy loss as it is loaded and unloaded (see, e.g., FIG. 15A). In contrast, a viscoelastic material exhibits a time delay in returning to its original shape, and some energy is lost (or absorbed) during deformation, such as by way of heat (see, e.g., FIG. 15B). The viscoelastic material exhibits both viscous damping and an elastic response during deformation. The viscoelastic material is modelled by a spring (which models the elastic behavior) in series with a dashpot (which models viscosity).

To the extent that displacement devices absorb energy during deformation, then less energy is available to be transferred to the wearer's head, which is a benefit of such displacement devices over other types that may primarily rely on sliding surfaces.

Figure 11:
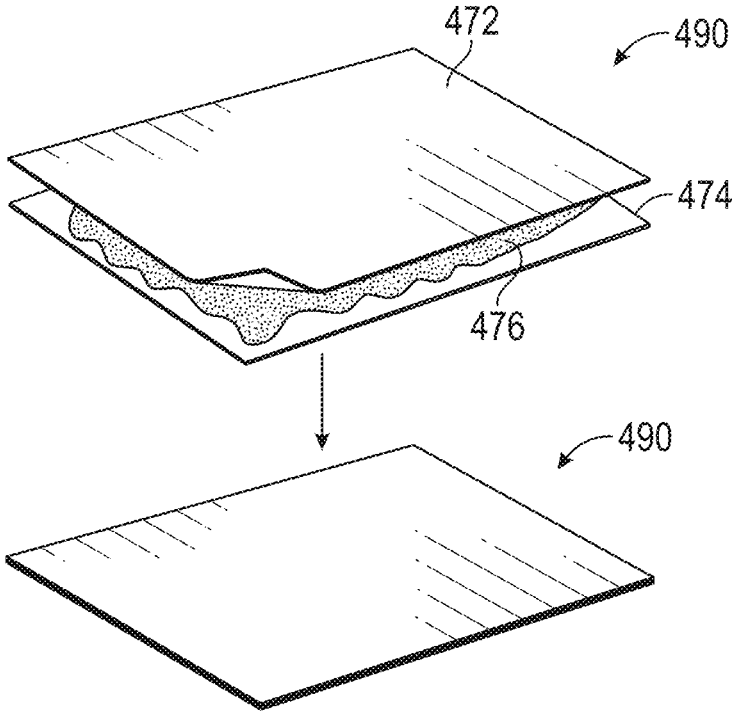
FIG. 11 is a schematic perspective view showing assembly of a displacement device according to another implementation.

FIG. 11 is a schematic perspective view of a displacement device 490 according to another implementation, showing it being assembled from components and in an assembled condition. First, a first sheet 472 and a second sheet 474 are assembled on opposite sides of a friction reducing material 476. The friction reducing material may comprise a lubricating substance. Then, the edges of the first sheet 472 and the second sheet 474 are secured together (such as by thermal bonding, adhesive or other suitable technique) so that the friction reducing material 476 is contained within the enclosed space defined by inner surfaces of the sheets 472, 474. The displacement device 470 can then be installed between two objects that are desired to move relative to each other in a predetermined manner with reduced friction and in some cases, added damping and/or allowable displacement. In contrast to the displacement device 390, which can be referred to as a shear component, the displacement device 470 relies on slip planes/a slip system in which parallel surfaces slip or slide past each other. The displacement device 470 on its own tends not to provide any damping or energy absorption, but it may "redirect" applied energy that is not wholly linear.

Figure 12:
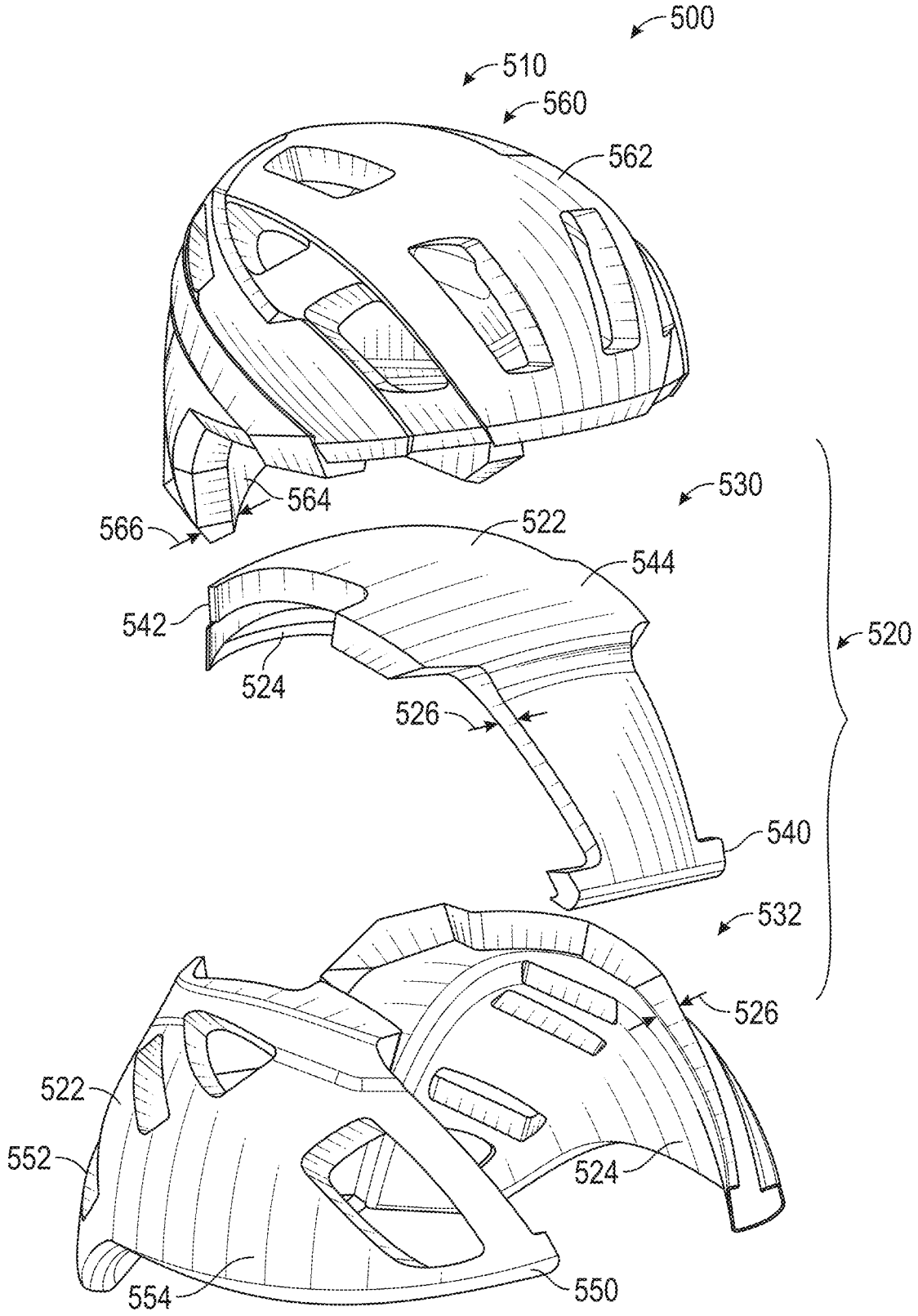
FIGS. 12 and 13 are exploded perspective views from different angles, respectively, another implementation of a helmet.
Figure 13:
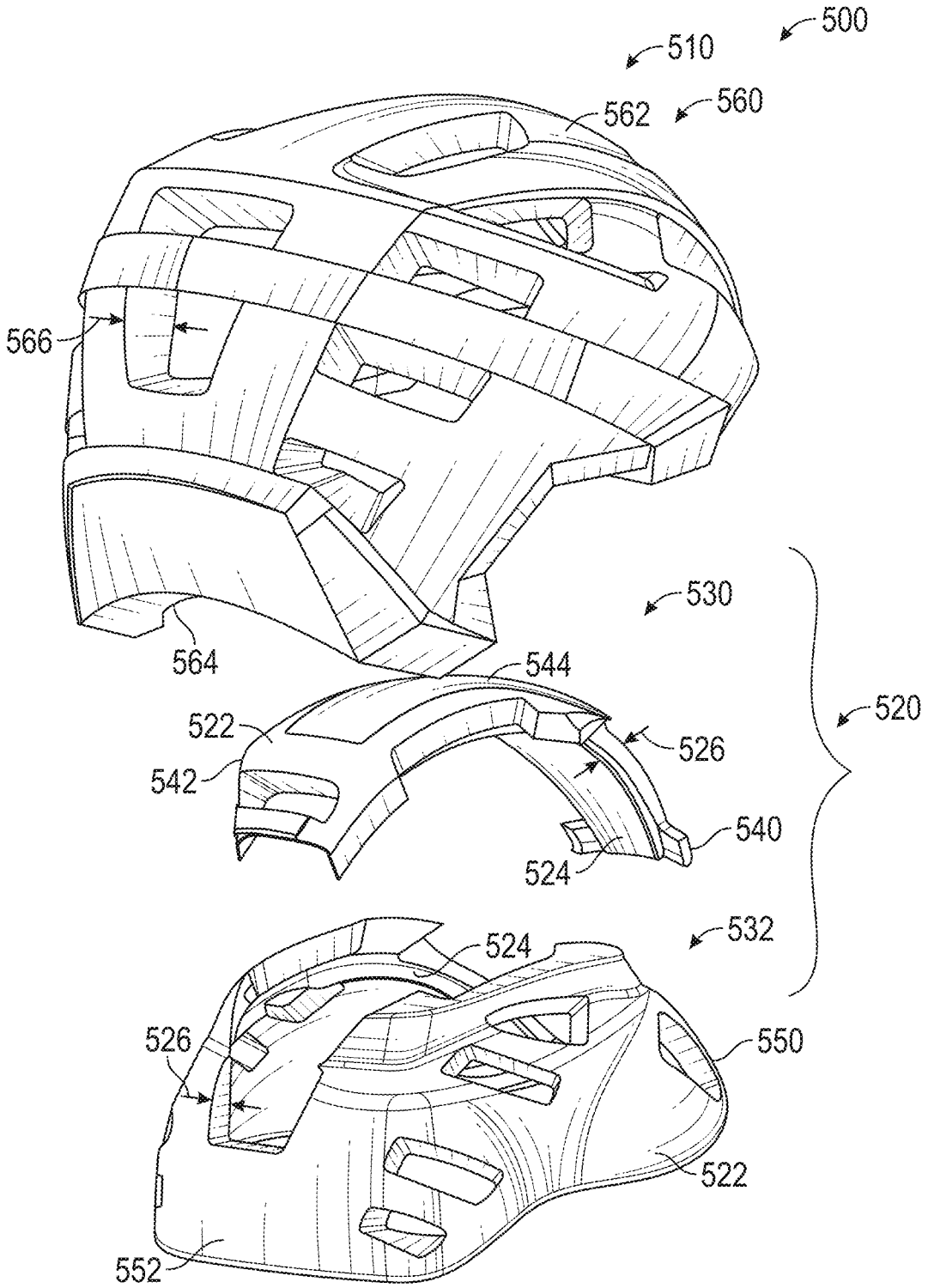
Figure 14:
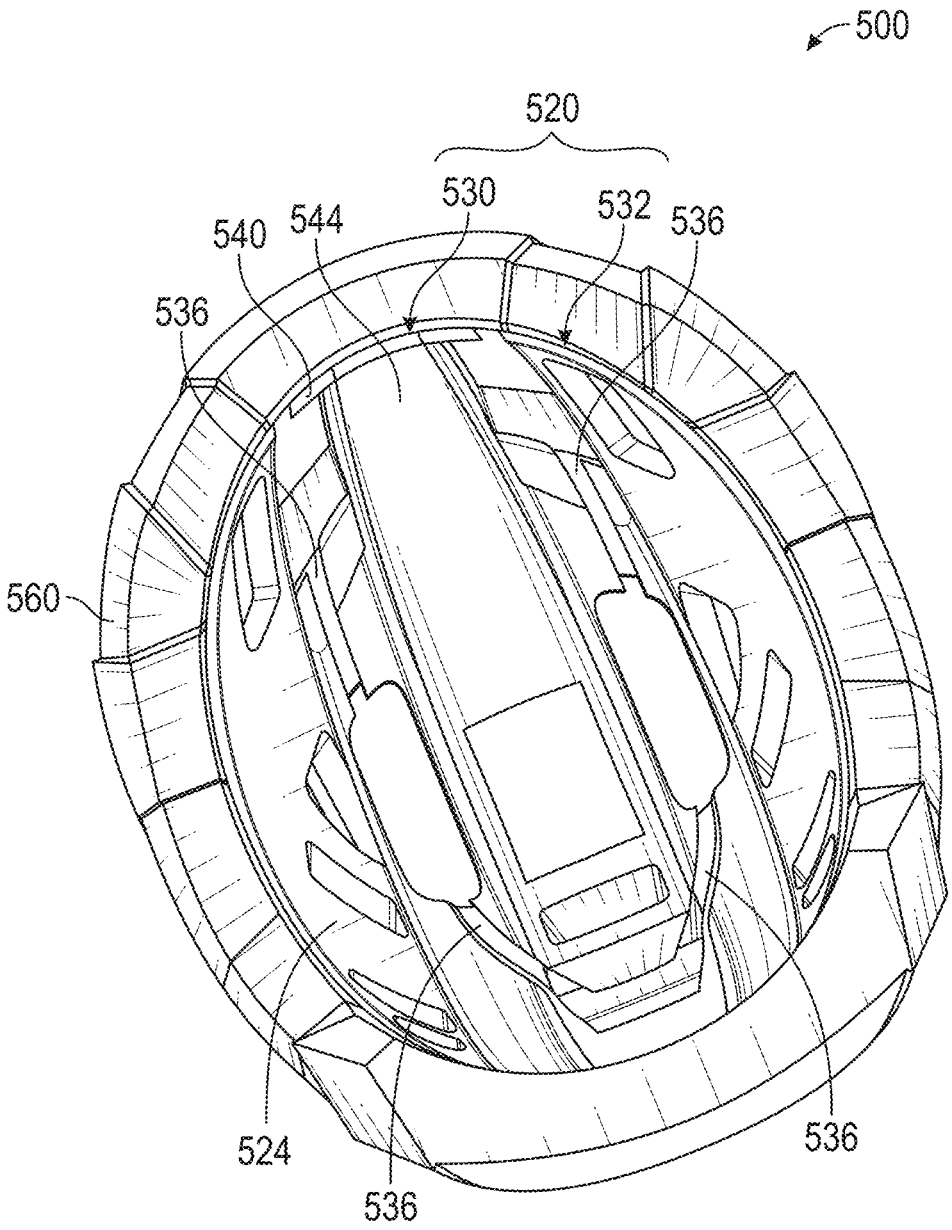
FIG. 14 is a bottom plan view of sectioned side elevation view of another implementation of the helmet.

In the above implementations of the helmet, the first energy absorbing layer 120 is formed of a single component. It is also possible for the energy absorbing layers to be formed of multiple components. For example, as shown in FIGS. 12-14, for a helmet 500, the first energy absorbing layer 520 can be formed of a first component 530 and a second component 532. In FIGS. 12-14, components having generally the same description as those for the helmet 100 set forth above are labelled with the same reference number, plus 400.

In the illustrated implementation, the first component 530 and the second component 532 are separate pieces, but they could be coupled together, such as with one more pieces of a flexible material. In the illustrated implementation, the first component 530 has a forward end 540, a rearward end 542 and a body 544. The first component 530 is positioned within a recess of the second component 532. As best seen in FIG. 12, the recess of the second component 532 is defined between spaced apart points at a forward end 550 and extends through a body 554 toward a rearward end 552. FIG. 14 is a bottom plan view of the assembled helmet 500 showing the resulting cavity for accommodating the wearer's head as defined by the first inner surface 524 of the first component 530 and the second component 532.

According to other implementations described below in connection with FIGS. 16-26, one or more shear components are arranged between an inner surface of the helmet and the wearer's head to permit movement of the helmet relative to the wearer's head through internal shear of the shear component(s). Such shear components may be used in addition to shear components located between two energy absorbing layers described above. In the example of FIGS. 16-26, the shear components are described for a helmet 600 as shown having a protective shell 610, a single energy absorbing layer 620, and an inner surface 624 thereof that generally defines an inner surface of the helmet 600. A shear component 690 is attached or coupled to the inner surface 624 of the helmet 600. Although the shear component 690 is referred to in the singular for ease of description, it is noted that multiple shear components or a shear component in multiple pieces, whether physically connected or separated, are also contemplated.

Figure 16:
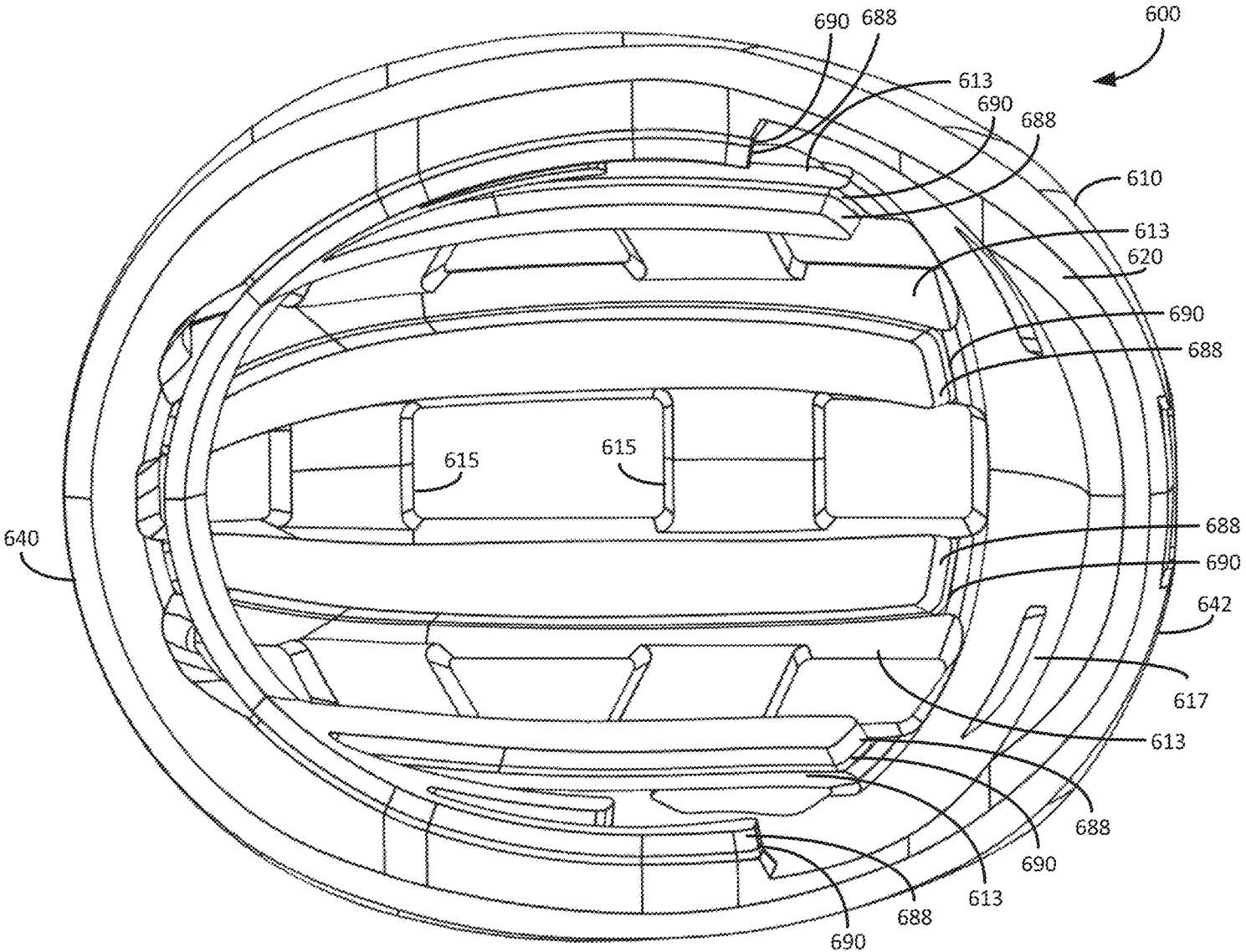
FIG. 16 is a bottom plan view of a helmet according to another implementation.
Figure 17:
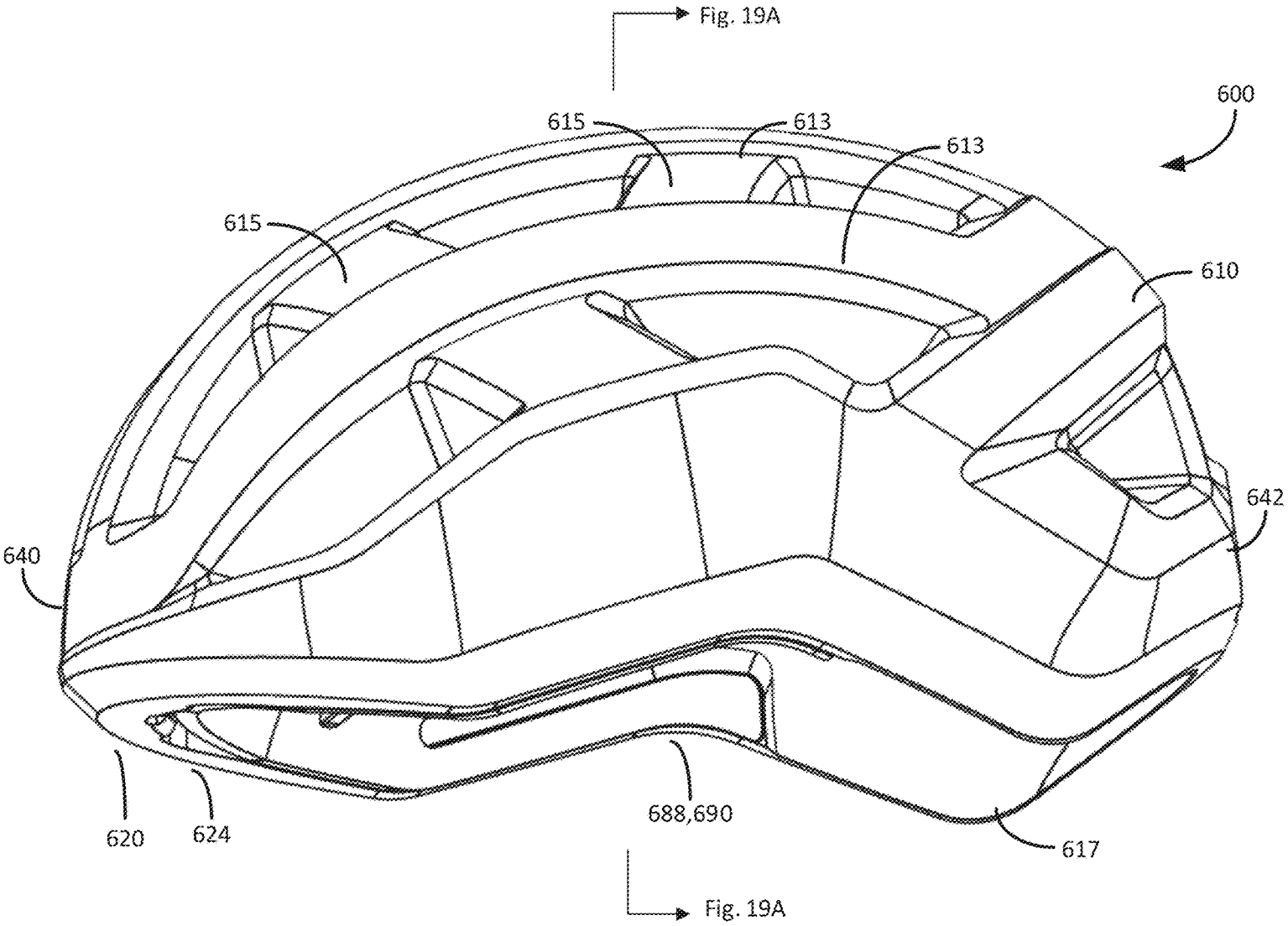
FIG. 17 is a side elevation view of the helmet of FIG. 16.

The shear component 690 may have an inner end that itself defines a head contact surface that contacts the wearer's head, or there may be a comfort pad 688 coupled to the shear component 690 at its inner end as shown in FIG. 16 that defines the head contact surface. The shear component 690 and the comfort pad 688 are shown slightly schematically in FIGS. 16 and 17. In some implementations, there is a head contact surface in at least one area defined at an end of the shear component, and a head contact surface in at least one other area defined by a comfort pad.

The shear component 690 is preferably configured to extend at least over a range in the circumferential direction of the wearer's head (i.e., within the transverse plane). For example, the shear component 690 in FIG. 16 extends in the circumferential direction from approximately the 6 o'clock position, around a front end 640 (clockwise in FIG. 16) and to approximately the 12 o'clock position.

Further, the shear component 690 can be positioned and shaped to extend in the sagittal plane and coronal plane directions as well. Conveniently, the shear component 690 can be configured as shown in FIG. 16 to follow (and be coupled to) features of the inner surface 624, such as longitudinal ribs 613. In the illustrated example, there are four longitudinal ribs 613, but this is illustrative only and not limiting in number. In other implementations, the shear component 690 can be configured to follow one or more lateral ribs 615 (FIGS. 16 and 17), either in addition to or instead of the longitudinal ribs 613.

The longitudinal ribs 613, as well as other locations on the inner surface 624 to which the shear component 690 is coupled, may be configured to protrude inwardly relative to immediate surrounding areas. For example, the circumferential rim area can also have a protruding rib (see FIG. 19A). In this way, the shear component 690 can deform as designed in the event of a rotational force, allowing movement of helmet outer portions (i.e., the shell 610 and the energy absorbing layer 620) relative to an inner surface of the shear component 690, which is designed to remain substantially stationary either directly against the wearer's head or holding the comfort pad 688 against the wearer's head. In some implementations, the longitudinal ribs 613 or other locations to which the shear component 690 is coupled are configured to protrude inwardly by approximately 5 mm relative to immediate surrounding areas. Alternatively, the immediately surrounding areas can be configured to be recessed by a similar distance.

Figure 18:
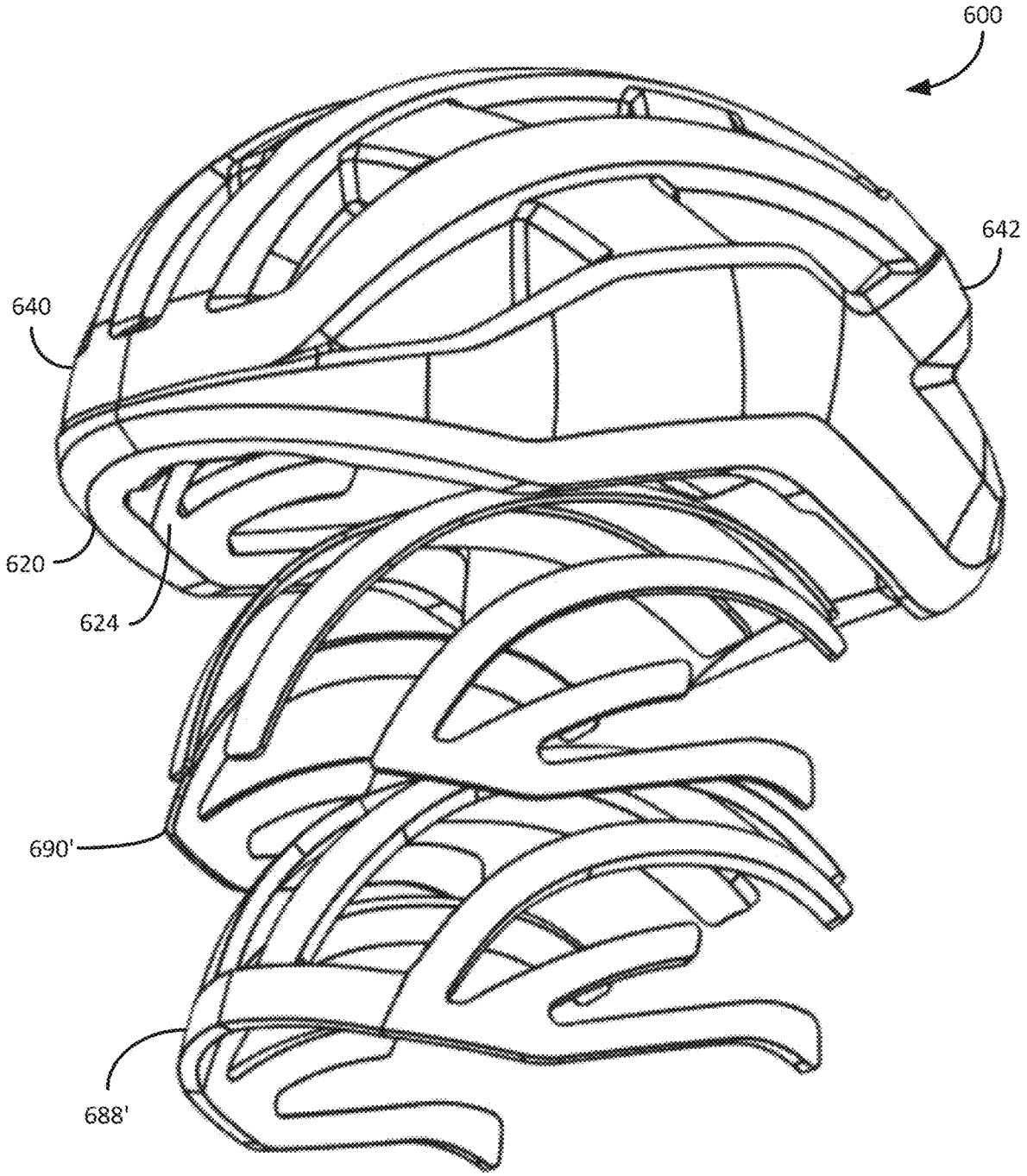
FIG. 18 is an exploded perspective view of the helmet of FIG. 16.

FIG. 18 is an exploded perspective view of the helmet 600, which is included to show the overall shapes and relative arrangement of the shear component and pad assembly, for a slightly modified comfort pad 688' for fitting interiorly of a slightly modified shear component 690' for coupling to the inner surface 624. For example, the shear component 690' as shown in FIG. 18 is selectively configured with gaps in the circumferential direction adjacent the front 640 of the helmet.

Figure 19A:
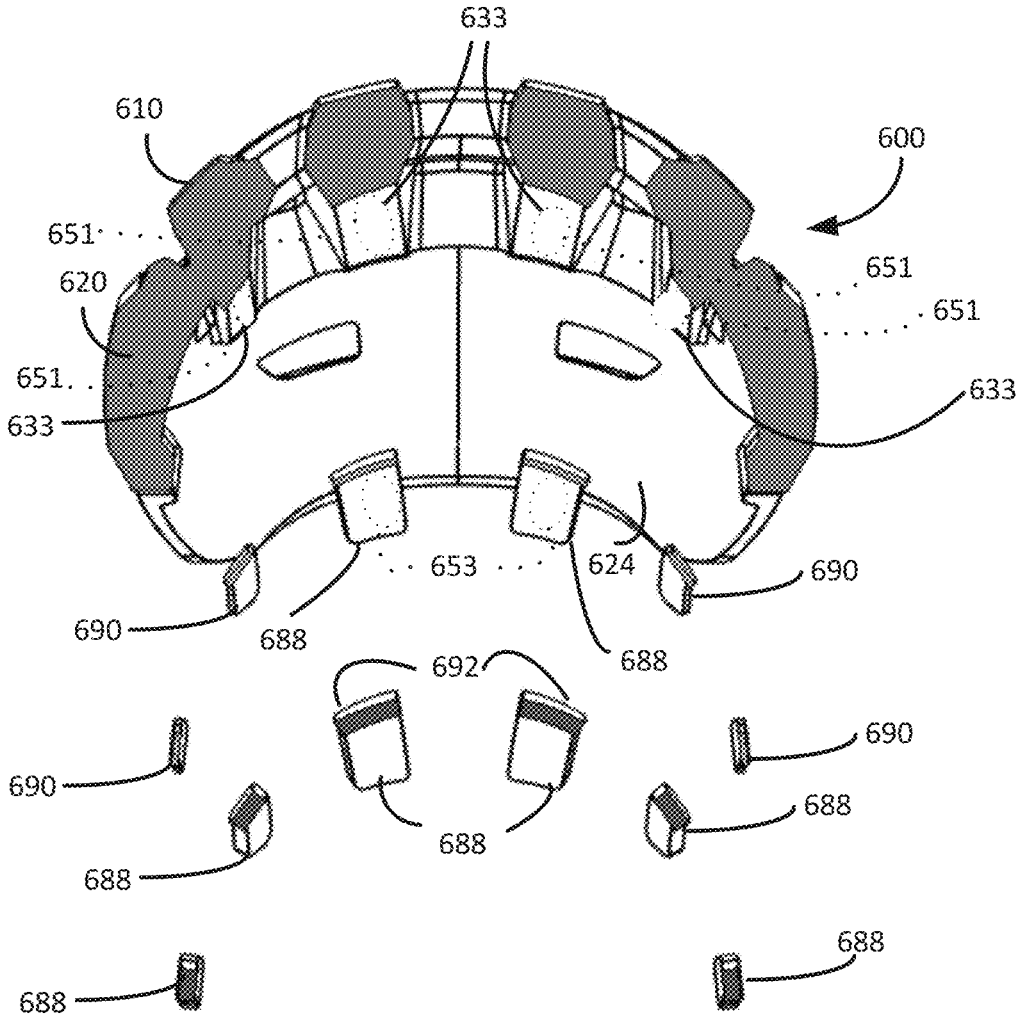
FIG. 19A is a section view in elevation of the helmet of FIG. 17.
Figure 19B:
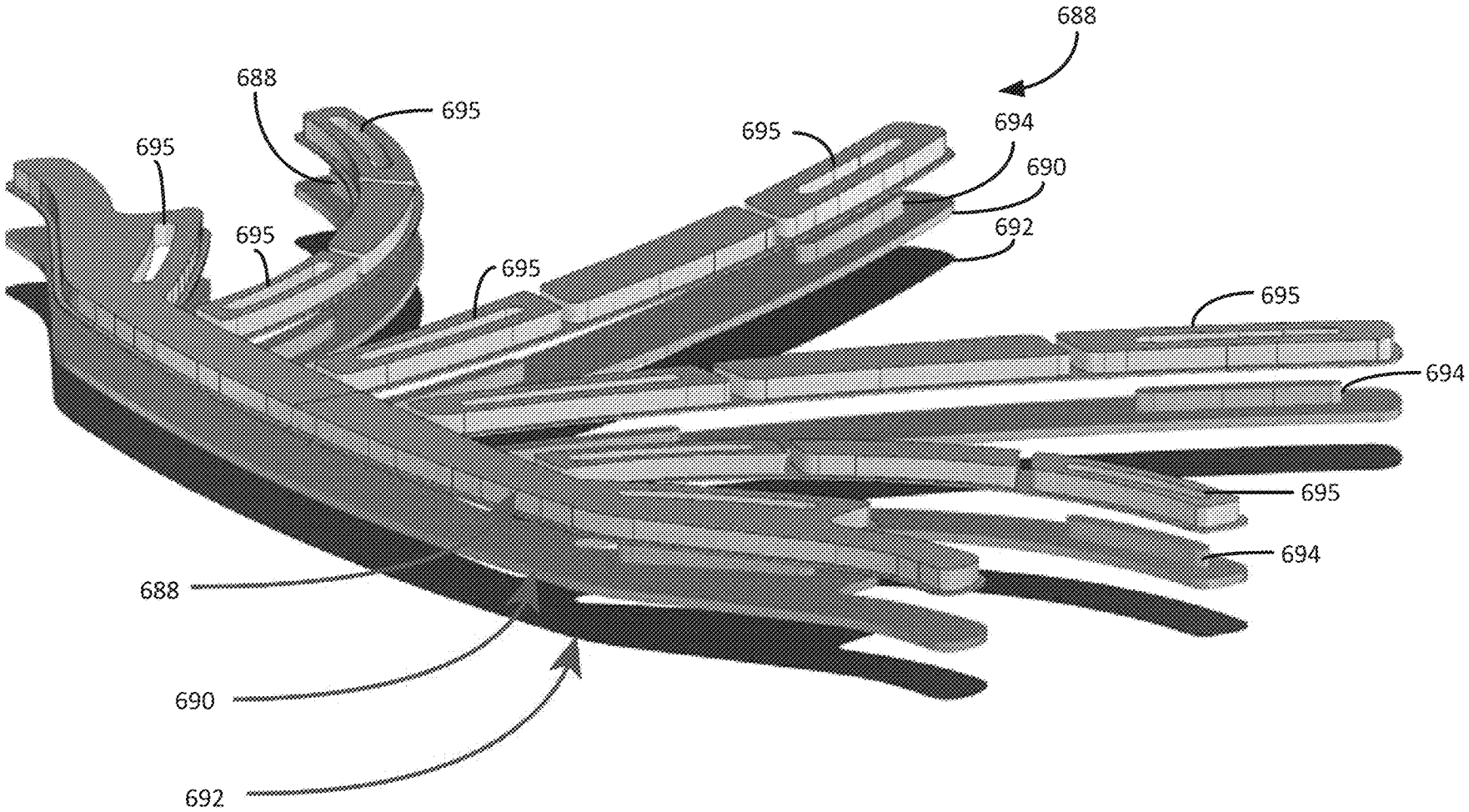
FIG. 19B is an exploded perspective view of a shear component and pad assembly of the helmet of FIG. 16 shown in isolation.

FIG. 19B is an exploded perspective view of the comfort pad 688 and shear component 690 shown isolated from the helmet, in a flattened state (i.e., before installation or after removal from the helmet), and in greater detail. FIG. 19B shows the comfort pad 688 aligned with and generally to the inside of the shear component 690. In the illustrated example, the comfort pad 688 and the shear component 690 are approximately coextensive (i.e., similarly shaped or having similar outer peripheries), but other non-coextensive configurations are also possible (see, e.g., the comfort pad 688' and the shear component 690'). Also, FIG. 19B shows that the shear component 690 can be provided with an attachment surface, such as with a layer of attachment textile 692 on its outer surface as shown, for coupling the shear component 690 and the comfort pad 688 assembly to the inner surface 624.

The shear component 690 can be coupled to the inner surface 624 by hook and loop or hook and pile fasteners (e.g., Velcro® fasteners) hereinafter referred to collectively as "touch fasteners," or other similar arrangement allowing for secure, reversible attachment of flexible materials. The shear component 690 can have the textile fabric 692 over its entire surface as described above that is coupleable to a corresponding touch fastener, or discrete touch fasteners, at selected locations. References to "touch fastener" herein include either component of a two-component fastener assembly, e.g., either the hook component or the loop component (or the pile component). The inner surface 624 can also be provided with corresponding touch fasteners at selected locations to which the shear component 690 can be secured (e.g., with hook portions), such as the representative locations 651 as shown in FIG. 19A. As also shown in FIG. 19A, an inner surface of the shear component 690 can also have touch fasteners at selected locations 653 for releasably coupling the comfort pad 688 in place. A least one outer surface of the comfort pad 688 can be formed of a textile fabric that is readily fastenable by touch fastening, as is described in further detail below.

The force required to separate the shear component 690 from the inner surface 624 can be set by selecting the touch fastener material(s) and the number and area of touch fastening locations. There may be occasional need to remove the shear component 690 from the helmet 600 for cleaning and/or replacement. Similarly, the comfort pad 688 and the shear component 690 can be separated from each other when desired, such as for cleaning and/or replacement.

The shear component can be formed of a silicone gel material or a polyurethane material, both of which are described above, or a thermoplastic elastomer (TPE) such as TPE having a Shore C hardness of approximately 19C, which is available from Zhongsu Enterprise (www.tpetpr.com). Other suitable TPE materials may have a shore C hardness in the range of 10-25. The material technical specification for TC-20CT TPE is reproduced below (and incorporated herein by reference):

| Property | | | Unit | Testing method | Testing condition | Testing valse |
|---|---|---|---|---|---|---|
| Physical properties | Specific gravity | | g/cm$^3$ | ASTM D792 | — | 0.830 |
| | Melt flow rate | | g/10 min | ASTM D1238 | 190° C. 325 g | 7 |
| Mechanical properises | Tensile properties | Tear strength | kg/cm | ASTM D624 | 500 mm/min | — |
| | | Tensile strength | kg/cm$^2$ | ASTM D412 | | — |
| | | Elongation at break | % | | | |
| Water content | | — | % | ZSW012 | 75° C.,40 S | 0.03 |
| hardness | | | ShoreC | ASTM D2240 | 1 S | 19 C. |

| | | | |
|---|---|---|---|
| Molding shrinkage(verticle/horizontal (%) | | 0-2/0-1.5 | |
| Temperature resistance (° C.) | ° C. | — | |
| Predrying temperature | ° C. | predrying time | H |

| Reference Processing condition | | Unit | Data |
|---|---|---|---|
| Cylinder temperature | Rear | ° C. | 160~170° C. |
| | Center | | 170~180° C. |
| | Front | | 190~200° C. |
| Eye mold temperature | | ° C. | 210~220° C. |

Note:
(look for mist side effect, please keep the mold temperature is just right eye)

Thermoplastic elastomers have the ability to stretch to moderate elongations and to return to near original shape. Thermoplastic elastomers may be injection molded, which makes them easier to use than some other elastomers.

By way of background, an elastomer is defined by mechanical response not by chemical structure. Elastomers comprise a diverse range of chemical structures although they are characterized as having weak intermolecular forces. An elastomer will undergo an immediate, linear and reversible response to high strain to an applied force. This response has a mechanical analogy with a spring according to Hooke's Law. Non-linear, time dependent mechanical response is distinguished as viscoelasticity according to the parallel spring and dashpot model. Time dependent irreversible response is a viscous response according to a dashpot model. An ideal elastomer will only exhibit an elastic response. Real elastomers exhibit predominately elastic response, however they also exhibit viscoelastic and elastic responses especially at higher strains. Robert Shanks and Ing Kong, Thermoplastic Elastomers, Chapter 8, retrieved from www.intechopen.com.

In some implementations, the shear component 690 is formed of an injection molded thermoplastic elastomer as described above with the attachment textile 692 present during the molding process. Alternatively, the shear component 690 and the attachment textile 692 can be joined together in a separate step, such as with adhesive. The comfort pad 688 can be formed in a heat press operation, such as from layers of cloth (textile(s)) and foam. The attachment textile 692 may assist in preventing tearing of the shear component 690 material, such as during removal of the shear component 690, while not interfering with its ability to undergo shear in response to an oblique impact.

Figure 20:
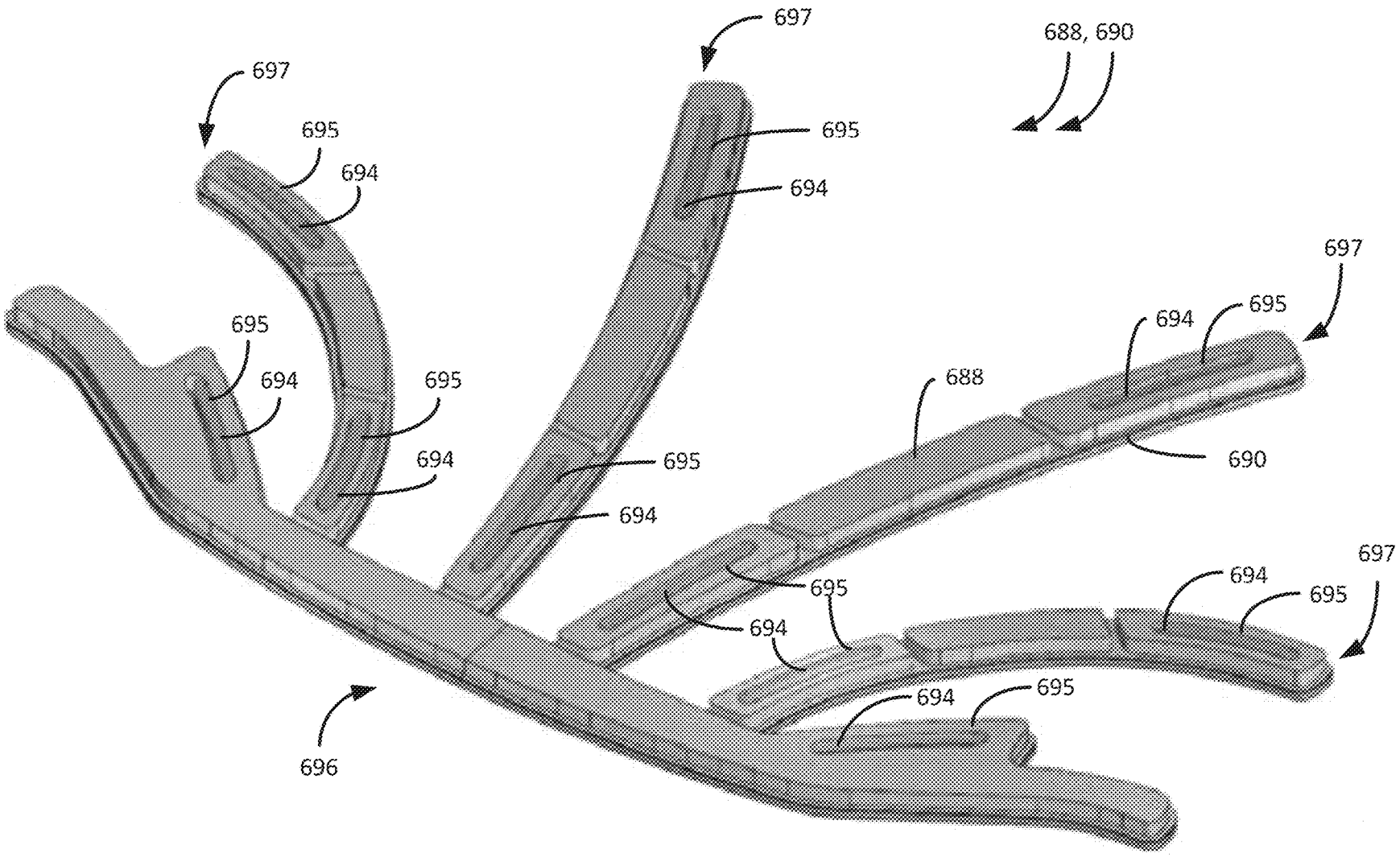
FIG. 20 is a perspective view of the shear component and pad assembly of the helmet of FIG. 16 shown assembled together but removed from the helmet.

The comfort pad 688 and the shear component 690 can be configured for engagement or inter-fitting with each other. For example, the comfort pad 688 can have openings or recesses shaped to receive protrusions extending from the shear component 690. In this way, the comfort pad 688 tends to move with the shear component 690, such as during shearing in response to rotational forces. Referring to FIG. 19B, the shear component 690 has protrusions such as ribs 694 and the comfort pad 688 has corresponding openings 695 shaped to receive the ribs 694. FIG. 20 is another perspective view showing the comfort pad 688 assembled together with the shear component 690 and the ribs 694 visible through the opening 695. Having at least a portion of the shear component 690, such as one or more of the ribs 694, remain visible after the comfort pad is assembled allows for easy visualization of the layered construction and verification of proper assembly, including for point-of sale explanation of operation.

As best shown in FIG. 20, the overall shape of the shear component 690 and the comfort pad 688 can be configured to have a base 696 and spaced-apart fingers 697 extending away from the base 696. In the illustrated implementation, the base 696 is the portion of the assembly configured to follow the circumferential direction of the helmet 600 in the transverse plane (see FIG. 16), such as from the 6 o'clock position, around a front end 640 (clockwise in FIG. 16) and to approximately the 12 o'clock position. The fingers 697 can be configured to follow internal features of the helmet 600, such as, in this example, the longitudinal ribs 613.

Figure 21A:
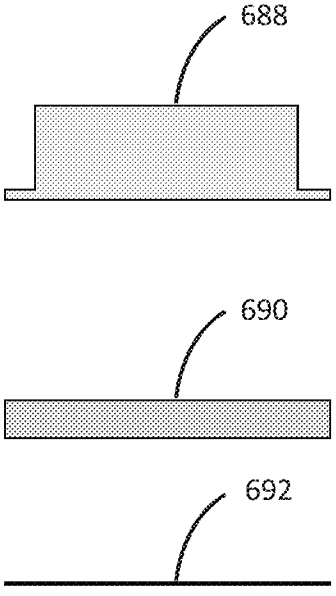
FIGS. 21A and 21B are exploded and assembled elevation views, respectively, of the shear component and pad assembly having a junction according to a first variation.
Figure 21B:
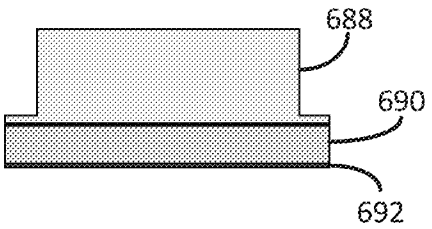
Figure 22A:
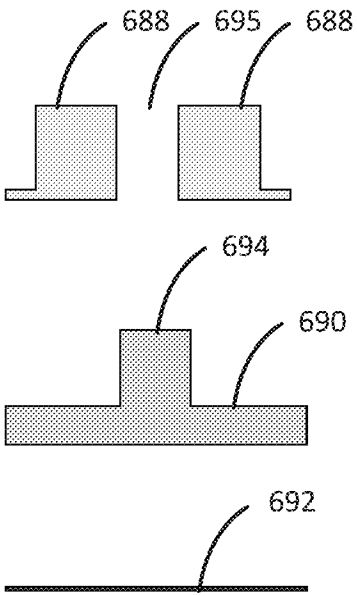
FIGS. 22A and 22B are exploded and assembled elevation views, respectively, of the shear component and pad assembly having a junction according to a second variation.

Along the base 696 and the fingers 697, the engagement or inter-fitting between the shear component 690 and the comfort pad 688 can take multiple different forms. FIGS. 21A-23B are schematic cross-sectional elevation views, exploded and assembled, showing different configurations. In FIGS. 21A and 21B, the comfort pad 688 is fit together with the shear component 690 at a simple planar intersection, sometimes referred to herein as a "stacked" configuration. In FIGS. 22A and 228, the comfort pad 688 has the opening 695, and the shear component 690 has the rib 694, sometimes referred to herein as an "aligned" configuration. In FIGS. 23A and 23B, the rib 694 has an enlarged distal end and the opening 695 has a corresponding chamfer shaped to receive the enlarged distal end of the rib 694, which is sometimes referred to herein as a "locking" configuration. In general, the comfort pad 688 and the shear component 690 can have one or more of the illustrated configurations, as well as other similar configurations, at different locations over the full extent of the base 696 and the fingers 697. The comfort pad and shear component constructions can have the multiple layers as described herein.

Further, the location, overall number, length, width and height of the ribs 694 or other engagement feature(s) can be selected to provide sufficient alignment and retention of the comfort pad 688 during use of the helmet.

Figure 22B:
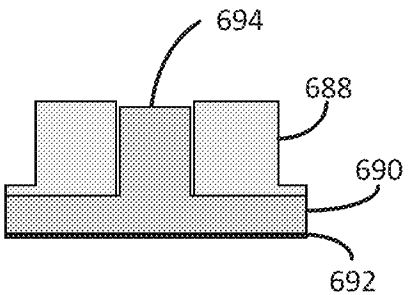
Figure 23A:
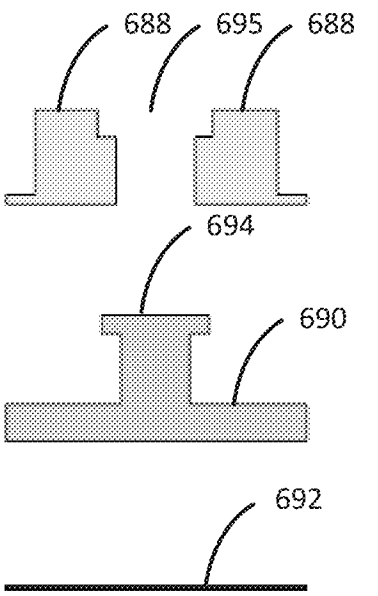
FIGS. 23A and 23B are exploded and assembled elevation views, respectively, of the shear component and pad assembly having a junction according to a third variation.
Figure 23B:
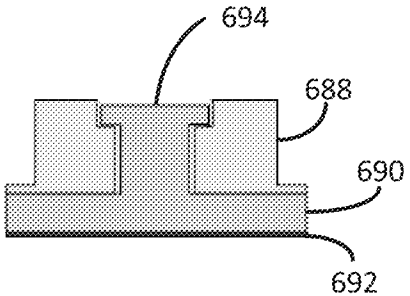

In some implementations, the rib 694 is dimensioned to be slightly recessed from the surrounding comfort pad 688, such as is shown in FIGS. 20, 22B and 23B, so that the comfort pad 688 makes primary contact with the wearer's head. In other implementations, the rib 694 can be approximately flush with the comfort pad 688 or even protruding relative to the comfort pad 688. In some implementations, there may be one or more locations where only shear component 690 is present, and the shear component (either in the form of a rib, a planar area or another configuration) is designed to contact the wearer's head directly, without interspersed comfort padding.

Figures 24A, 24B:
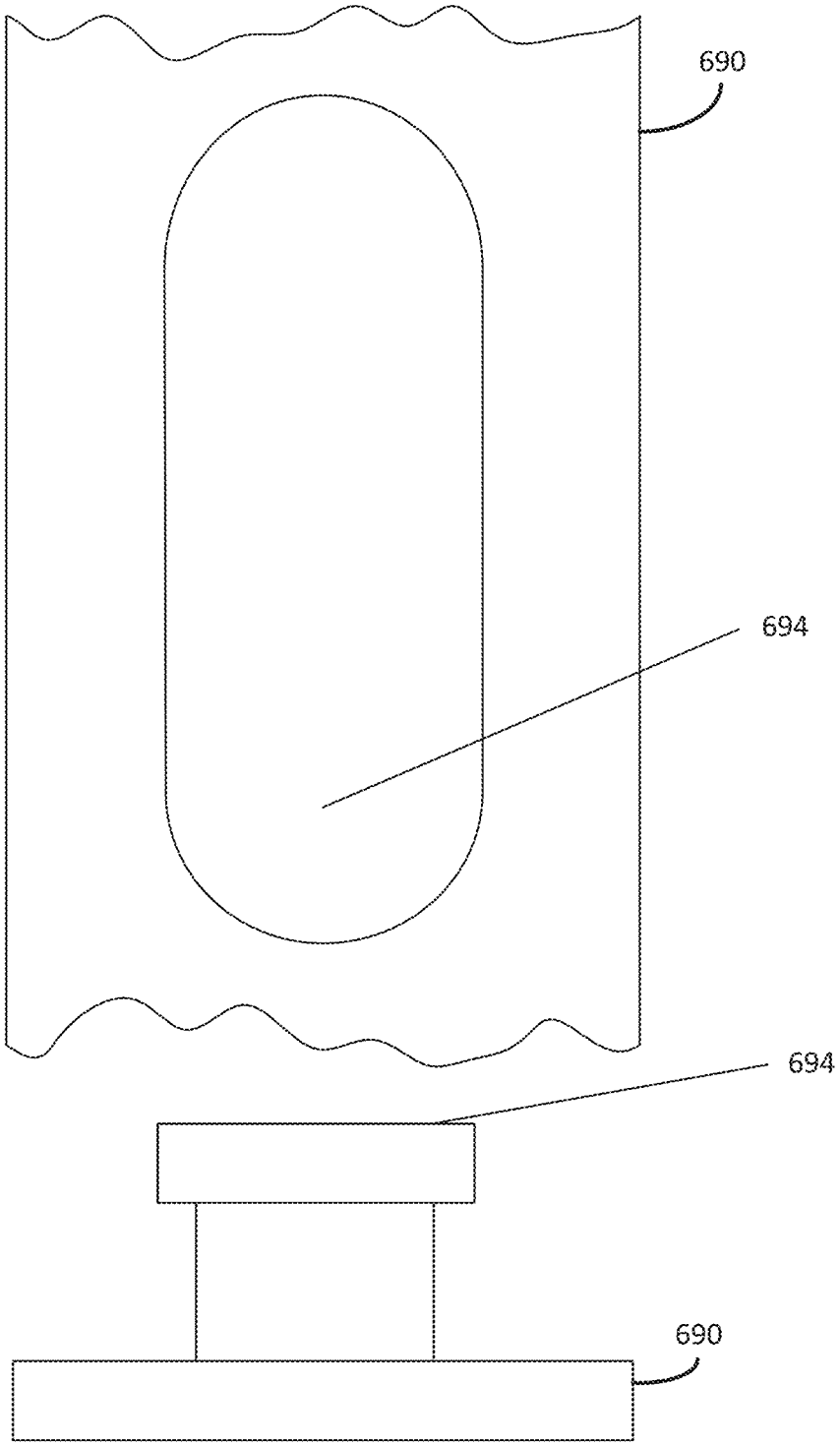
FIGS. 24A and 24B are elevation and plan views of a portion of the shear component of FIGS. 23A and 23B.

For example, FIG. 24A is a schematic elevation view of the shear component 690 shaped with the rib 694 having the enlarged end similar to FIG. 23, but shown without any surrounding comfort pad. FIG. 24B is a schematic top plan view of the shear component 680 and rib 694 of FIG. 24A.

Figure 25:
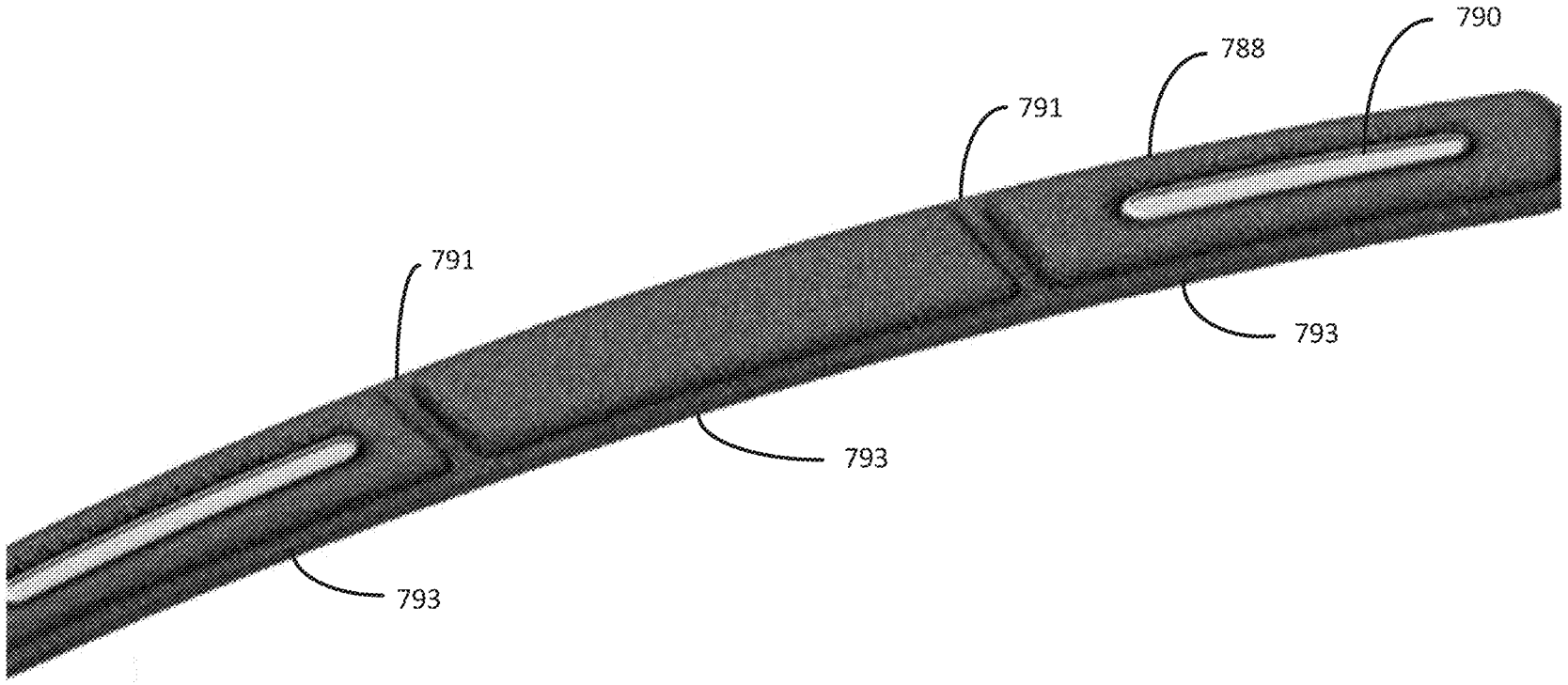
FIG. 25 is a perspective drawing showing a portion of a shear component and pad assembly according to another variation.

FIG. 25 is an enlarged perspective view of a portion of a comfort pad 788 and a shear component 790, which are illustrated at higher resolution to show the comfort pad can be configured to have a low profile, and with boundaries 791 separating adjacent comfort pad sections 793.

Referring again to FIG. 16, in the illustrated examples, the shear component 690 does not extend entirely around the circumference of the helmet 600. As shown, an area adjacent the rear end 642 of the helmet is not provided with any shear component or comfort pad. Instead, a recessed area 617 is defined in the vicinity of the rear end 642 to more readily accommodate rotation of the helmet 600, such as in the illustrated transverse plane (and other planes), relative to the wearer's head. The wearer's head is contacted by the comfort pad 688/shear component 690 assembly coupled to the ribs 613, and there is no contact with the wearer's head in the recessed area 617. Because the wearer's head and the corresponding shaped helmet 600 have an oval shape rather than a circular shape, providing the recessed area 617 allows easier rotation of the helmet relative to the wearer's head than if the entire circumference of the helmet 600 is tightly fitted to the wearer's head.

Figure 26:
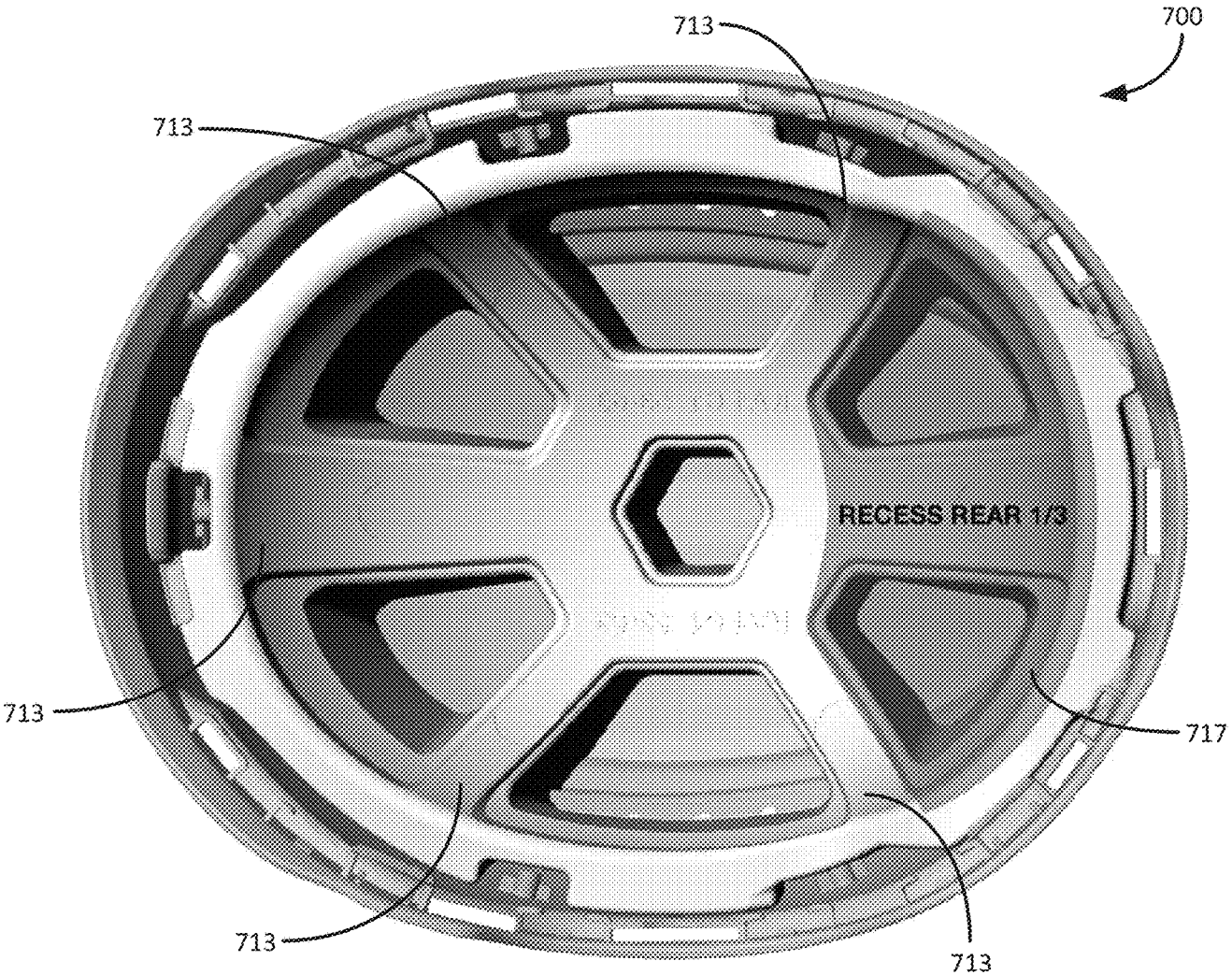
FIG. 26 is a bottom plan view of a helmet similar to the helmet of FIG. 16 but having an alternative structural rib arrangement.

A recessed area 717 of roughly ⅓ of the interior of a helmet 700 according to a second example is shown in FIG. 26. FIG. 26 also shows ribs 713 to which the shear component is coupled that are configured to extend approximately radially instead longitudinally or laterally.

Although not specifically shown, any of the helmets described herein, including the helmets 600 and 700, are intended to have a fit system, such as the fit system 180.

In view of the many possible embodiments to which the disclosed principles may be applied, it should be recognized that the illustrated embodiments are only preferred examples and should not be taken as limiting the scope of protection. Rather, the scope of protection is defined by the following claims. We therefore claim all that comes within the scope and spirit of these claims.

We claim:

1. A helmet, comprising:

a protective shell forming an outer surface of the helmet;

an energy absorbing layer defining an inner surface of the helmet, the protective shell and energy absorbing layer comprising longitudinal ribs that protrude radially inwardly and transverse ribs intersecting the longitudinal ribs at intersections, further comprising a plurality of ventilation openings located adjacent at least some of the intersections;

an integrated subassembly of a shear component, a comfort pad and an attachment textile, wherein the integrated subassembly is removably mountable to the energy absorbing layer with the attachment textile, the integrated subassembly having a base conformable to extend along a front circumferential area of the energy absorbing layer and separated fingers extending from the base that are conformable to extend along at least two of the longitudinal ribs and border at least a first ventilation opening of the plurality of ventilation openings, wherein the shear component comprises a flexible sheet of a sheet thickness;

the comfort pad comprises a flexible sheet arranged in a stacked configuration with the shear component, wherein the comfort pad and the shear component are inter-fitted together; and the attachment textile comprises a flexible sheet that supports the shear component and provides resistance against tearing of the shear component when the integrated subassembly is flexed for mounting to and unmounting from the helmet, wherein, in response to an oblique impact to the helmet with the integrated subassembly mounted to the energy absorbing layer, the shear component undergoes internal shear to allow displacement between the helmet and a wearer's head.

2. The helmet of claim 1, wherein the shear component is formed of a material having a shear modulus of GPa 0.0001 to GPa 0.03.

3. The helmet of claim 1, wherein the shear component is formed of a material having a Shore 00 durometer of 0 to 60.

4. The helmet of claim 1, wherein the shear component is formed of a material having a Shore C hardness of 10 to 25.

5. The helmet of claim 1, wherein the shear component comprises a silicone gel sheet material.

6. The helmet of claim 1, wherein the shear component comprises an injection-molded thermoplastic elastomer material.

7. The helmet of claim 1, wherein the shear component comprises a thermoplastic urethane (TPU) material.

8. The helmet of claim 1, wherein the shear component is non-sliding relative to the comfort pad and the wearer's head on an inner side thereof and relative to the attachment textile and an outwardly adjacent portion of the helmet on an outer side thereof.

9. The helmet of claim 1, wherein the shear component comprises a viscoelastic material.

10. The helmet of claim 1, wherein the shear component is configured such that internal shear produces a damped shear action exhibiting progressively greater force in shear without high rebound.

11. The helmet of claim 1, wherein the attachment textile is provided as part of an insert molded textile, and wherein the integrated subassembly is removably coupled to the energy absorbing layer by touch fastening between the attachment textile and touch fasteners at multiple locations on the energy absorbing layer.

12. The helmet of claim 1, wherein at least two of the longitudinal ribs have respective inner surfaces positioned radially inwardly relative to surrounding areas and defining respective mounting areas for mounting the integrated subassembly to the helmet.

13. The helmet of claim 12, wherein the mounting areas are positioned radially inwardly by at least 5 mm.

14. The helmet of claim 1, further comprising a rear recess that is recessed relative to a forward area of the helmet such that the wearer's head does not contact the inner surface of the helmet within the rear recess when the helmet is worn, thereby allowing the wearer's head to rotate relative to the inner surface more readily in response to the oblique impact to the helmet.

15. The helmet of claim 1, wherein the comfort pad and the shear component in the stacked configuration are interfitted together by raised ribs engaged in openings.

* * * * *